US010736442B2

(12) United States Patent
Valiulis et al.

(10) Patent No.: US 10,736,442 B2
(45) Date of Patent: Aug. 11, 2020

(54) PRODUCT DISPLAY BELT AND ASSEMBLY

(71) Applicant: DaVinci Industries, Northfield, MN (US)

(72) Inventors: Carl Valiulis, Rockford, IL (US); Anthony Valiulis, Rockford, IL (US)

(73) Assignee: DaVinci Industries, Northfield, MN (US)

( * ) Notice: Subject to any disclaimer, the term of this patent is extended or adjusted under 35 U.S.C. 154(b) by 0 days.

(21) Appl. No.: 16/546,650

(22) Filed: Aug. 21, 2019

(65) Prior Publication Data

US 2019/0374048 A1 Dec. 12, 2019

Related U.S. Application Data

(63) Continuation of application No. 15/660,519, filed on Jul. 26, 2017, now Pat. No. 10,426,278.

(51) Int. Cl.

| | |
|---|---|
| ***A47F 5/08*** | (2006.01) |
| ***B65D 75/56*** | (2006.01) |
| ***A47F 10/00*** | (2006.01) |

(52) U.S. Cl.

CPC ..... *A47F 5/0861* (2013.01); *A47F 5/0823* (2013.01); *A47F 5/0838* (2013.01); *A47F 10/00* (2013.01); *B65D 75/566* (2013.01); *A47F 2010/005* (2013.01)

(58) Field of Classification Search

CPC .... A47F 5/0861; A47F 5/0838; A47F 5/0869; A47F 5/0823; A47F 10/00; A47F 2010/005; B65D 75/566; G07F 11/58

USPC ..... 211/49.1

See application file for complete search history.

(56) References Cited

U.S. PATENT DOCUMENTS

| | | | | | |
|---|---|---|---|---|---|
| 3,785,501 | A * | 1/1974 | Canning | A47F 5/0861 | 211/57.1 |
| 3,814,282 | A * | 6/1974 | Stoltz | G07F 11/58 | 221/85 |
| 3,912,084 | A * | 10/1975 | Valiulis | A47F 5/0823 | 248/220.22 |
| 4,475,658 | A * | 10/1984 | Roberts | A47F 5/0807 | 211/54.1 |
| 4,583,308 | A * | 4/1986 | Taub | A47F 5/0869 | 248/220.41 |
| 4,693,024 | A * | 9/1987 | Fast | A47F 5/0869 | 40/584 |
| 4,694,595 | A * | 9/1987 | Fast | A47F 5/0869 | 211/54.1 |
| 4,823,964 | A * | 4/1989 | Lundberg | A47F 5/0869 | 211/57.1 |

(Continued)

*Primary Examiner* — Patrick D Hawn

(74) *Attorney, Agent, or Firm* — Boardman & Clark LLP

(57) ABSTRACT

A product display belt for a product display assembly may comprise a flexible strip having a top surface, a bottom surface, a front end and a back end; a plurality of hinges mounted to the bottom surface of the flexible strip to form a linear array of separated hinges extending from the front end towards the back end of the flexible strip; and a plurality of flaps, each flap having a front facing surface, a back facing surface, and a top surface, each flap mounted to an associated hinge of the plurality of hinges at the back facing surface below the top surface of the flap such that the flap has a free top end and extends downwardly away from the bottom surface of the flexible strip. Other product display belts and product display assemblies comprising the belts are provided.

15 Claims, 24 Drawing Sheets

(56) References Cited

U.S. PATENT DOCUMENTS 4,882,868 A * 11/1989 Fast ..... A47F 5/0869 40/642.01
4,934,080 A * 6/1990 Karnes ..... A47F 5/0869 40/642.01
5,009,334 A * 4/1991 Bodkins ..... A47F 1/128 211/54.1
5,123,189 A * 6/1992 Fast ..... A47F 5/0869 211/59.1
5,261,175 A * 11/1993 Gebka ..... A47F 5/0869 40/642.01
5,322,175 A * 6/1994 Nobili ..... B65D 75/36 211/183
5,325,616 A * 7/1994 Valiulis ..... A47F 5/0869 211/54.1
5,499,723 A * 3/1996 Morrow ..... A47F 5/0823 211/59.1
5,641,077 A * 6/1997 Tufano ..... A47F 1/128 211/54.1
5,711,432 A * 1/1998 Stein ..... A47F 5/0861 211/57.1
5,893,467 A * 4/1999 Burchell ..... A47F 5/0823 211/51
5,906,283 A * 5/1999 Kump ..... A47F 1/128 211/54.1
5,971,593 A * 10/1999 McGrady ..... G07F 9/026 221/13
5,984,118 A * 11/1999 Morrow ..... A47F 5/0823 211/59.1
6,059,124 A * 5/2000 Weck ..... A47F 5/0869 211/57.1
6,102,192 A * 8/2000 Tomuro ..... A47F 1/128 198/747
6,131,748 A * 10/2000 Kawasaki ..... A47F 1/128 211/54.1
6,439,423 B1 * 8/2002 Suzuki ..... G07F 11/58 221/81
7,178,678 B2 * 2/2007 Mansfield ..... A47F 5/0861 211/59.1
7,566,037 B2 * 7/2009 Vogler ..... A47F 1/128 211/54.1
7,708,153 B2 * 5/2010 Mansfield ..... A47F 5/0861 211/7
7,768,399 B2 * 8/2010 Hachmann ..... G08B 13/1472 340/568.1
7,905,364 B2 * 3/2011 Pail ..... A47F 5/0869 211/59.3
8,523,012 B2 * 9/2013 Richardson ..... A47F 5/0861 211/51
8,534,469 B2 * 9/2013 Northrup, Jr. ..... A47F 5/0861 211/57.1
9,386,864 B2 * 7/2016 Pongrac ..... A47F 5/0861
10,016,070 B1 * 7/2018 DeSena ..... A47F 1/128
2003/0188470 A1 * 10/2003 Valiulis ..... A47F 5/0823 40/642.01
2005/0006329 A1 * 1/2005 Williquette ..... A47F 5/0006 211/113
2007/0170133 A1 * 7/2007 Bryson ..... A47F 1/128 211/94.01
2016/0367049 A1 * 12/2016 Wirengard ..... A47F 5/0838
2018/0296007 A1 * 10/2018 Berglund ..... A47F 1/128

* cited by examiner

PRODUCT DISPLAY BELT AND ASSEMBLY

CROSS-REFERENCE TO RELATED APPLICATIONS

This application is a continuation of and claims priority to U.S. Nonprovisional application Ser. No. 15/660,519, filed on Jul. 26, 2017, now U.S. Pat. No. 10,426,278, entitled "Product Display Belt and Assembly", the entire contents of which is hereby incorporated by reference in its entirety.

BACKGROUND

A variety of devices and systems are used in retail stores to display different types of merchandise. These devices and systems seek to combine the features of orderly display, ease of use, inventory monitoring and control, and security. However, existing devices and systems exhibit numerous drawbacks as they attempt to achieve such features.

SUMMARY

The present disclosure provides a product display belt, a product display assembly which includes the belt, and a merchandise system which includes the belt and the assembly.

In one aspect, a product display belt for a product display assembly is provided. In an embodiment, the belt comprises a flexible strip having a top surface, a bottom surface, a front end and a back end; a plurality of hinges mounted to the bottom surface of the flexible strip to form a linear array of separated hinges extending from the front end towards the back end of the flexible strip; and a plurality of flaps, each flap having a front facing surface, a back facing surface, and a top surface, each flap mounted to an associated hinge of the plurality of hinges at the back facing surface below the top surface of the flap such that the flap has a free top end and extends downwardly away from the bottom surface of the flexible strip.

In another aspect, a product display assembly is provided comprising a body, the product display belt mounted to the body, and a product display rail mounted to the body, the product display rail configured to receive a plurality of hanging products.

In another aspect, a product display assembly is provided comprising a body having a top surface, a bottom surface, a back surface extending from the top surface to the bottom surface, and a front end opposite the back surface; a product display belt mounted to the body; and a product display rail comprising an elongated hanging portion, the product display rail mounted to the body such that the elongated hanging portion extends from the back surface of the body towards the front end of the body and approximately parallel to the bottom surface of the body. The product display belt comprises a flexible strip having a top surface, a bottom surface, a front end and a back end; a plurality of hinges mounted to the bottom surface of the flexible strip to form a linear array of separated hinges extending from the front end towards the back end of the flexible strip; and a plurality of flaps, each flap mounted to an associated hinge of the plurality of hinges such that the flap extends downwardly away from the bottom surface of the flexible strip and the bottom surface of the body.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings.

DETAILED DESCRIPTION

The present disclosure provides a product display belt, a product display assembly which includes the belt, and a merchandise system which includes the belt and the assembly.

Figure 1:
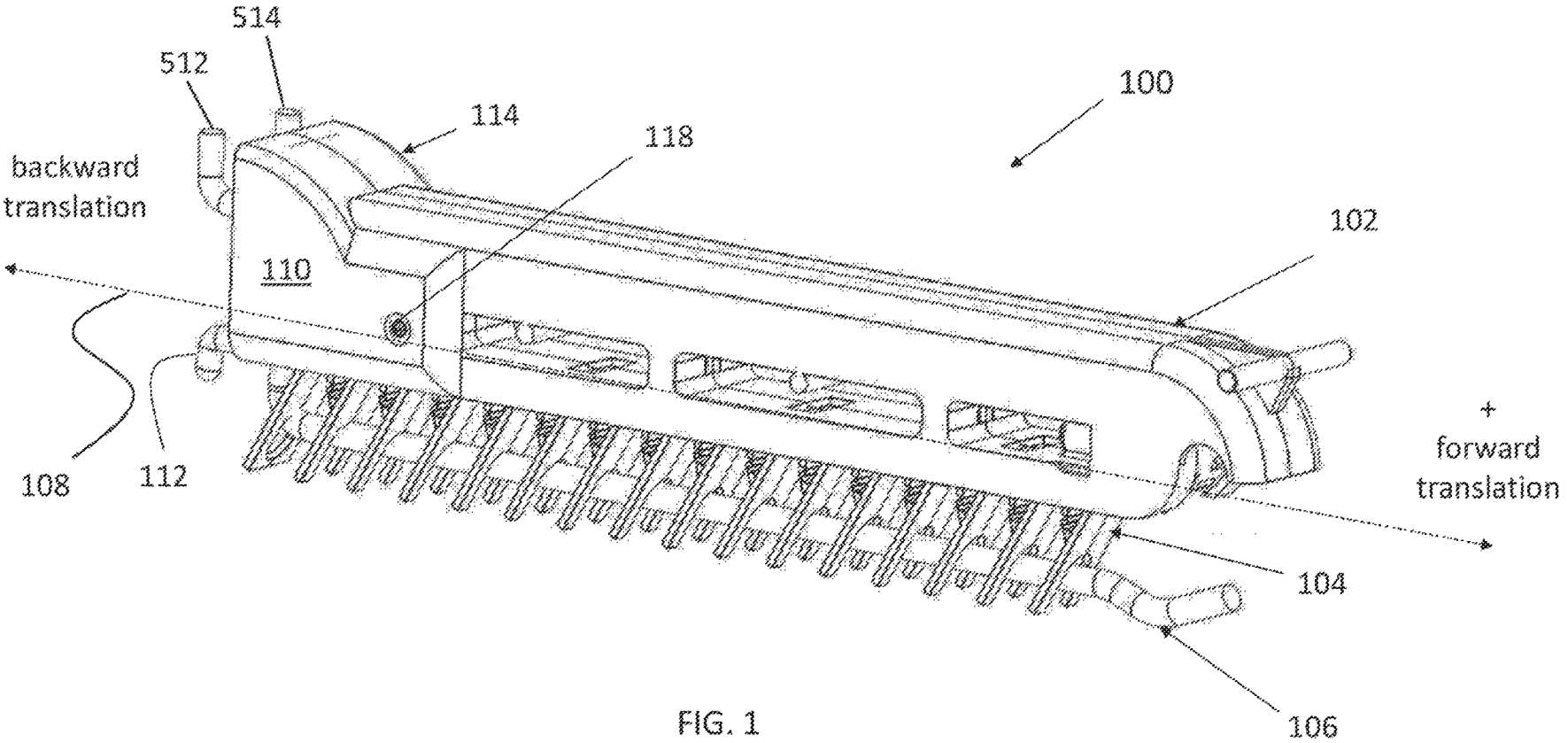
FIG. 1 depicts a perspective view of a product display assembly according to an illustrative embodiment.
Figure 2:
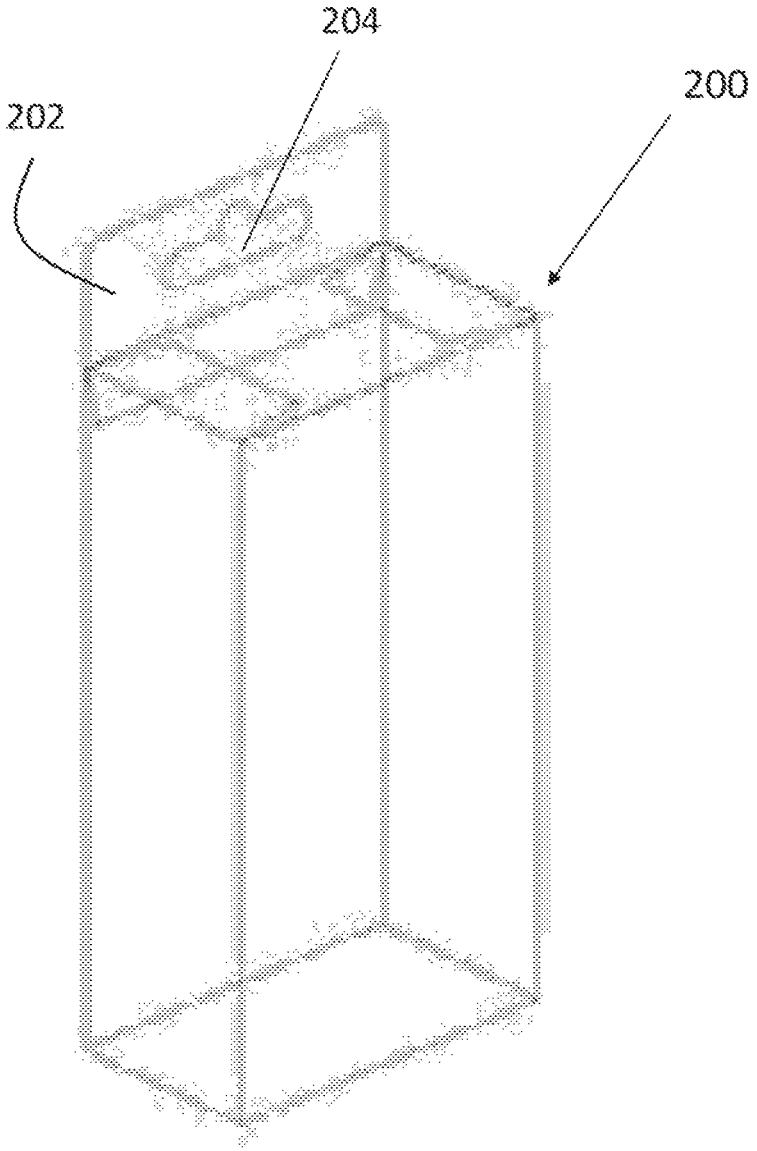
FIG. 2 depicts a perspective view of a package for a product to be displayed on the product display assembly of FIG. 1.

FIG. 1 shows a perspective view of an illustrative product display assembly 100. The product display assembly 100 is configured to support a plurality of hanging products, e.g., retail products, in a linear array and to mount to a display panel, e.g., a perforated panel such as a pegboard. The products to be displayed may be contained within a package configured to be hung on a hook, rod, bar, beam, etc., via an opening defined in the package. By way of illustration, FIG. 2 depicts a package 200 configured to contain a product for sale. The package 200 includes a tab 202 which defines a hole 204 to receive a hook, rod, bar, beam, etc. for hanging the package 200 and its contents thereon.

Figure 3A:
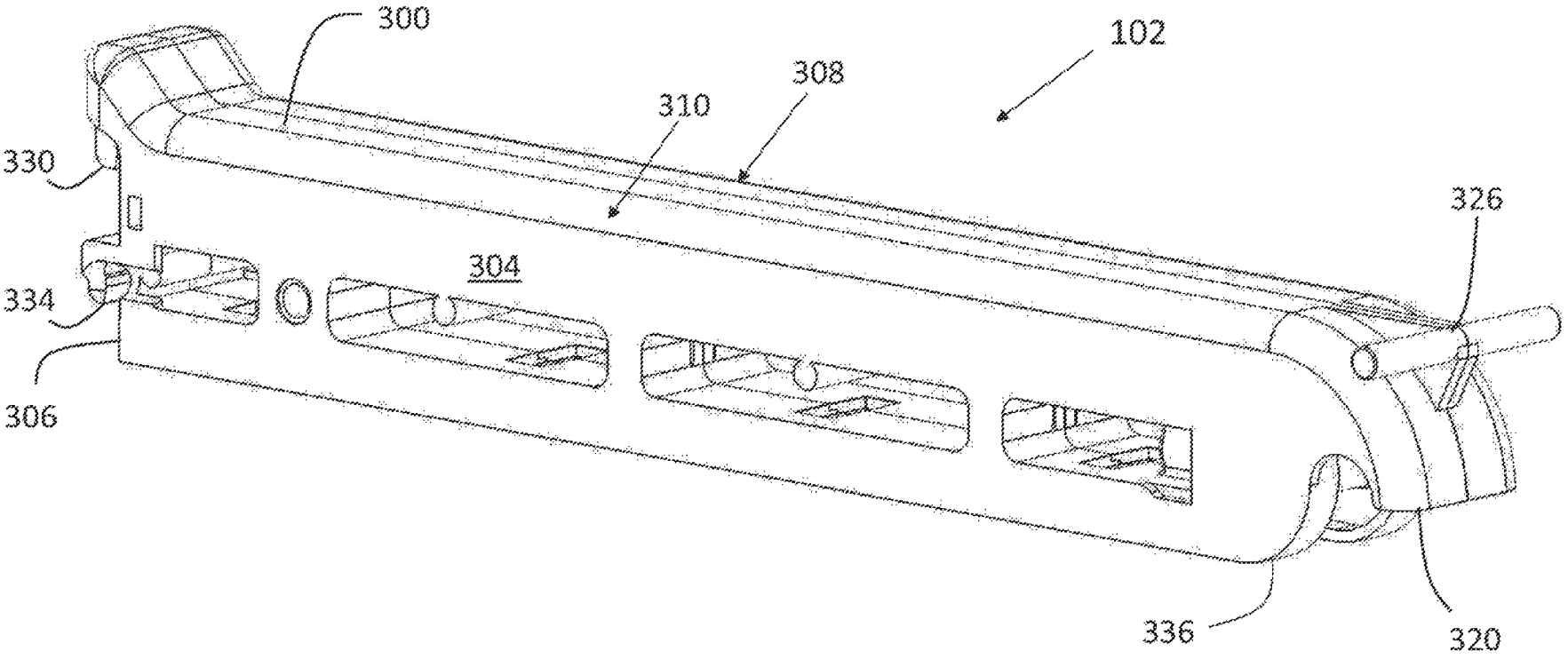
FIG. 3A depicts a perspective view of a body of the product display assembly of FIG. 1.
Figure 3B:
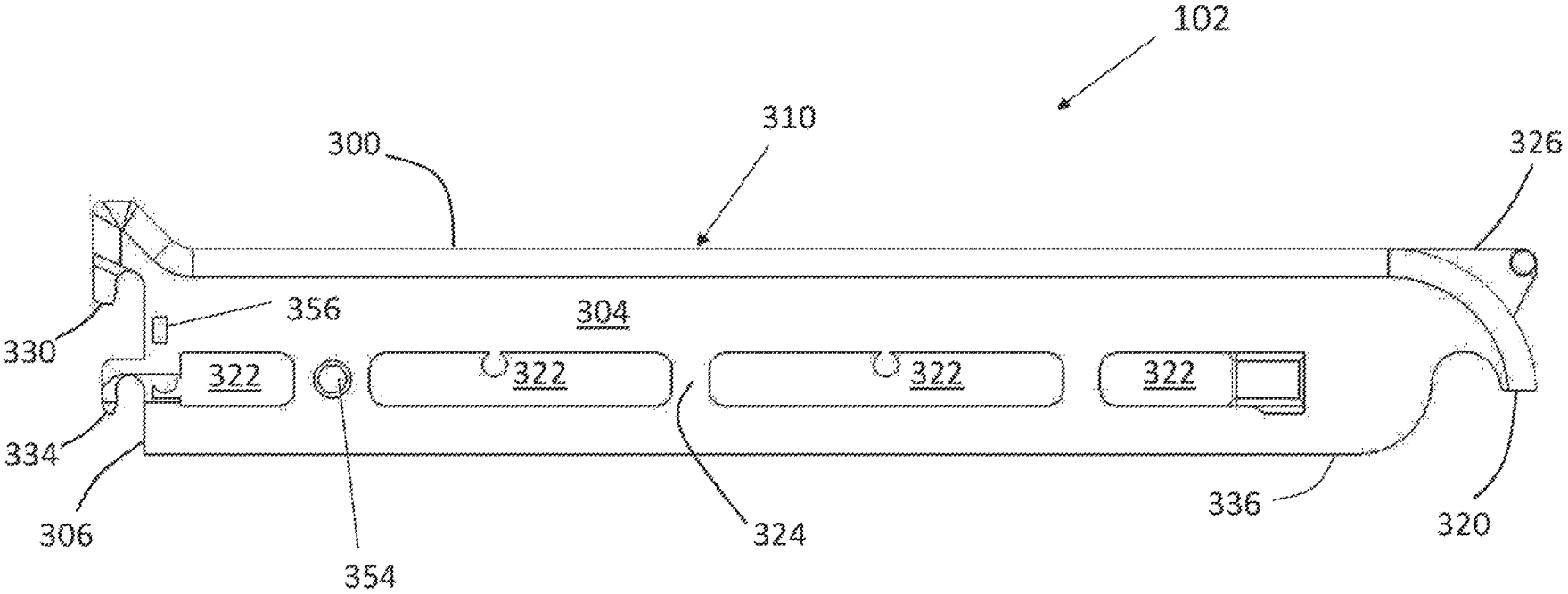
FIG. 3B depicts a left side view of the body of FIG. 3A
Figure 3C:
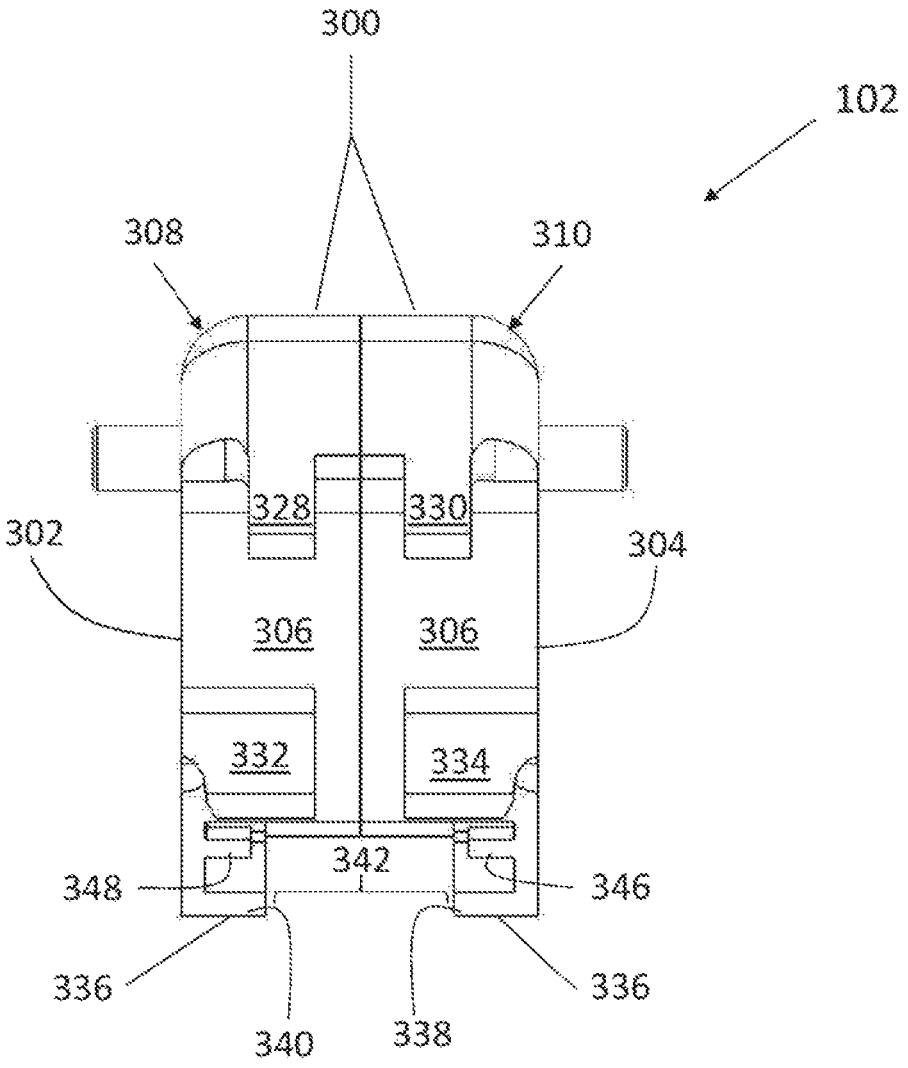
FIG. 3C depicts a back view of the body of FIG. 3A.
Figure 3D:
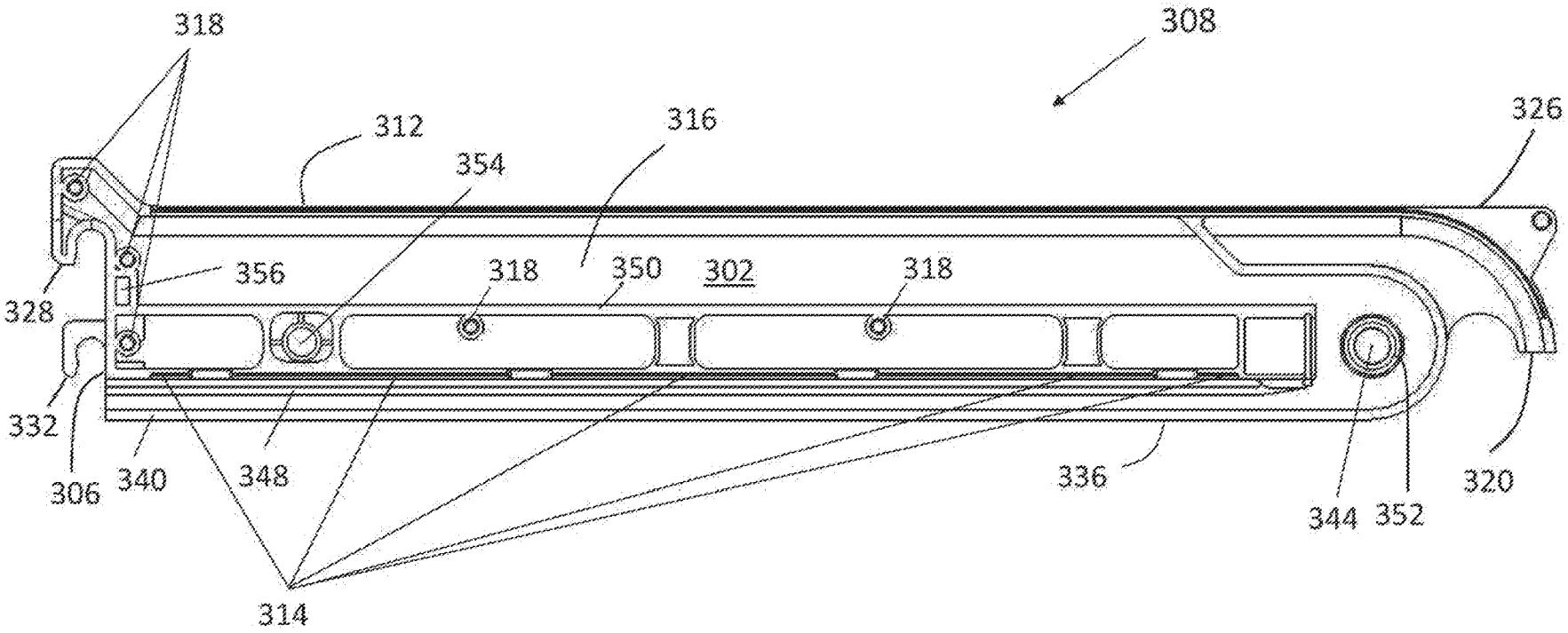
FIG. 3D depicts a left side view of a right shell of the body of FIG. 3A.

Turning back to FIG. 1, the product display assembly 100 may include a body 102, a product display belt 104, and a product display rail 106. The longitudinal axis 108 of the product display assembly 100 is also labeled. Movement towards the right hand arrow of the longitudinal axis 108 corresponds to forward translation (+) while movement towards the left hand arrow corresponds to backward translation (−) along the longitudinal axis 108. FIGS. 3A-3D show additional details of the body 102. FIG. 3A shows a perspective view of the body 102. FIG. 3B shows a left side view of the body 102. FIG. 3C shows a back view of the body 102. FIG. 3D shows a left side view of a right shell 308 of the body 102, revealing the interior configuration of the right shell 308.

The body 102 of the product display assembly 100 is configured to support and/or house various other components of the product display assembly 100. The body 102 may include a top wall 300, a right side wall 302, a left side wall 304, and a back wall 306. The body 102 may be formed as two shells, e.g., the right shell 308 and a left shell 310, configured to mount together. Various mechanisms may be used to mount the two shells 308, 310 to each other. By way of illustration and as shown in FIG. 3D, an elongated tab extending along a top edge of one of the shells (e.g., the left shell 310) may be used to snap fasten to an elongated notch 312 formed along a top edge of the other shell (e.g., the right shell 308). Other similar tabs and notches may be formed on along other surfaces of the shells. By way of illustration, five elongated tabs 314 may be mounted to the right shell 308 and projecting away from an inside surface 316 of the right side wall 302. The tabs 314 may be used to snap fasten to elongated notches mounted to the left side wall 304. Further securing of the two shells 308, 310 together may be accomplished via a plurality of rods 318 mounted to the right shell 308 and projecting away from the inside surface 316. These rods 318 may be inserted into tubes mounted to the left side wall 304. The number of tabs, notches, rods, and tubes as well as their distribution and dimensions are not particularly limited, but may be selected to provide a desired degree of security in the mounting.

The outer surfaces of the walls of the body 102 may take on a variety of shapes. At a front end 320 opposite the back wall 306, the top wall 300 may curve downward to form a hook or beak-like shape. In addition, the walls of the body 102 need not be solid and continuous. As shown in FIG. 3B, the right side wall 302 and left side wall 304 may define a plurality of apertures 322 distributed along the longitudinal dimension of the body 102, each which extends from an outer surface of the right side wall 302 through the body 102 to an outer surface of the left side wall 304. Such apertures 322 may be useful for limiting the overall material in the body 102, and thus reducing its weight and cost. However, wall material (one such region 324 of wall material is labeled in FIG. 3B) separating adjacent apertures is useful for imparting strength and rigidity to the body 102. The number of apertures as well as their distribution and dimensions are not particularly limited, but may be selected to provide a desired balance between weight/cost and strength/rigidity.

The body 102 may include a projection 326 mounted to the top wall 300. The projection 326 may be used to mount a label or a label holder for identifying information about the products being displayed. The label holder may include an antenna configured to provide Radio Frequency Identification (RFID) of individual products mounted to the product display assembly 100. This is by contrast to including such antennae on the individual products themselves.

Figure 5B:
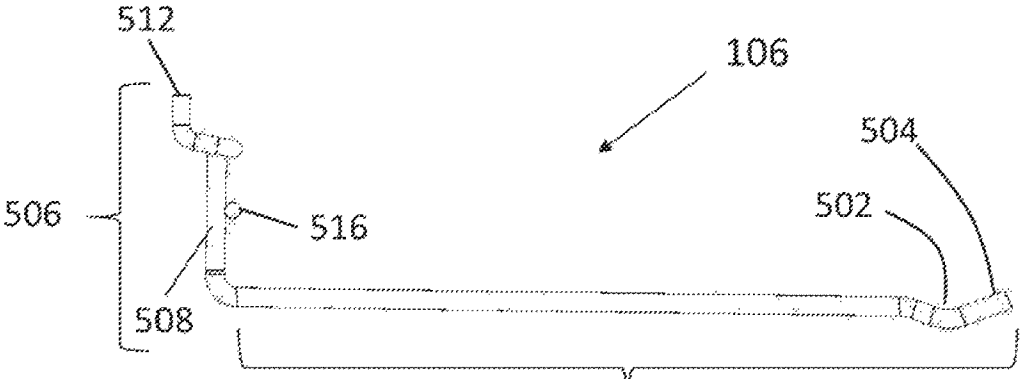
FIG. 5B depicts a left side view of the product display rail of FIG. 5A.
Figure 5A:
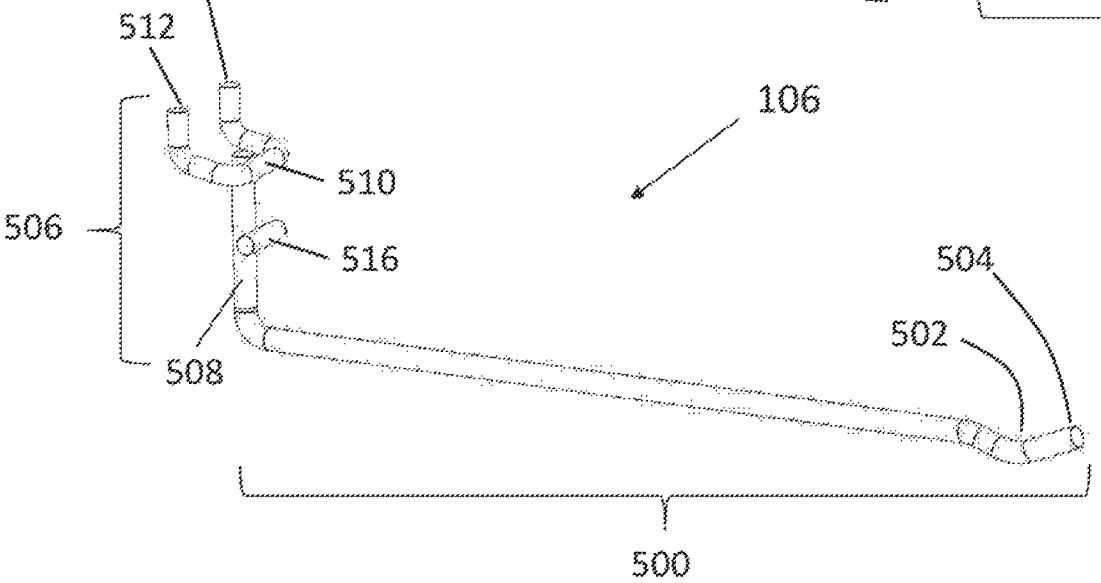
FIG. 5A depicts a perspective view of a product display rail of the product display assembly of FIG. 1.

The body 102 may be configured to mount to one or more panel mounting hooks, e.g., for releasably mounting the product display assembly 100 to the display panel. As shown in FIGS. 5A-5B, panel mounting hooks 512, 514 may be provided by the product display rail 106. As shown in FIGS. 3A-3D, the panel mounting hooks 512, 514 (and thus the product display rail 106) may be releasably mounted to the body 102 via a right upper hook 328 and a left upper hook 330 mounted to the back wall 306 and configured to receive a crossbar 510 connecting the panel mounting hooks 512, 514. (See also FIGS. 5A and 5B.) For additional support, a right lower hook 332 and a left lower hook 334 may be mounted on the back wall 306 and configured to receive an additional crossbar 516 mounted to the product display rail 106. (See FIG. 5.) The panel mounting hooks 512, 514 need not be provided by the product display rail 106. Similar panel mounting hooks may be provided by a panel mounting cap mounted to the back wall 306 of the body 102. Alternatively, the back wall 306 itself may include panel mounting hooks for direct mounting to the display panel. Other mechanisms (i.e., besides hooks) for mounting the product display rail 106 to the body 102 and for mounting the body 102 to the display panel may be used. Similarly, the number of hooks as well as their dimensions and placement are not limited, but selected to provide a desired degree of security in the mountings.

Figure 4:
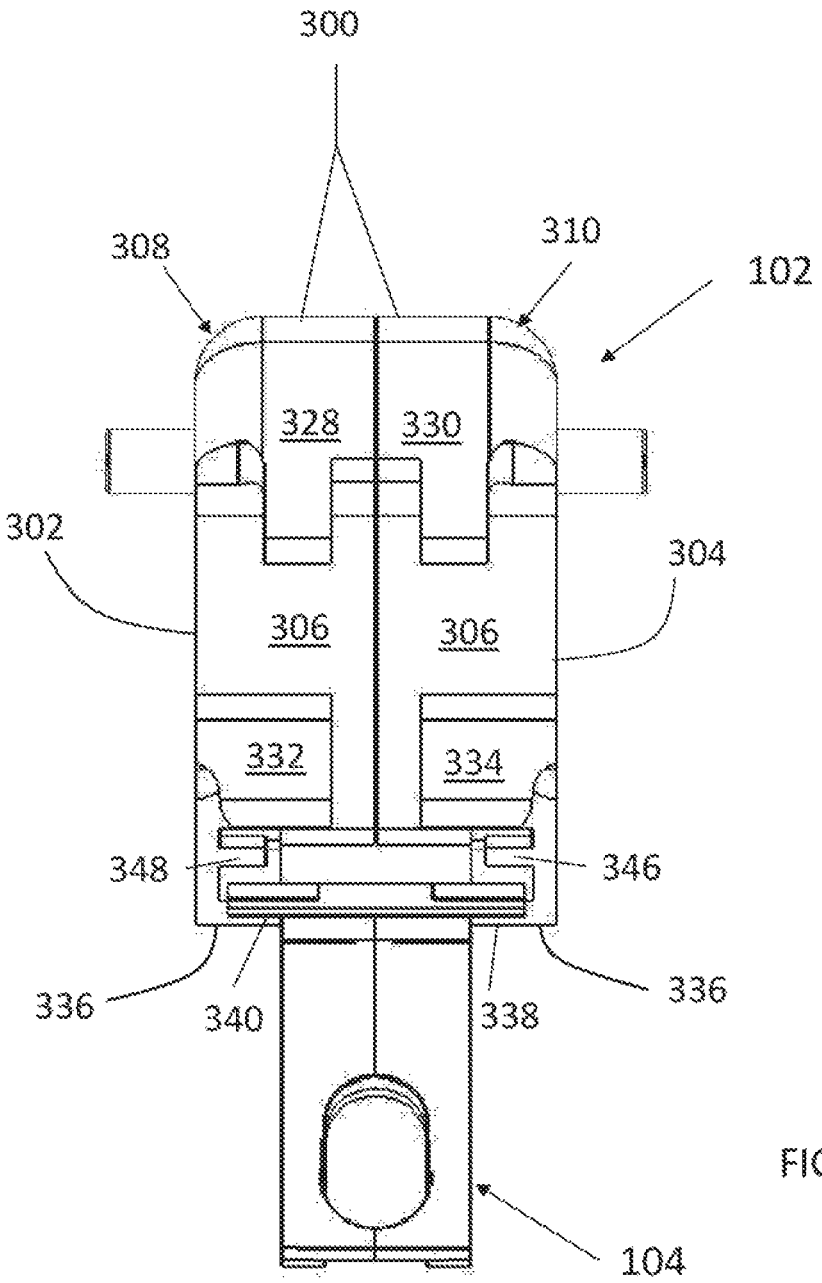
FIG. 4 depicts a back view of the body of FIG. 3A with an illustrative product display belt mounted thereon.

The body 102 defines an interior in which a portion of the product display belt 104 belt is retained, the other portion of which projects downwardly from a bottom surface 336 of the body 102. As shown in FIGS. 3C and 3D, a left lower rail 338 may be mounted to the inside surface of the left side wall 304 and a right lower rail 340 mounted to the inside surface 316 of the right side wall 302 to form a track along which the product display belt 104 may be held approximately parallel to the bottom surface 336 and translate forwards (+) and backwards (−). The term "approximately parallel" is used throughout this disclosure in view of the fact that inherent limitations in manufacturing the components of the product display assembly 100 and mounting the components together may prevent a perfectly parallel orientation. An identical view of the body 102 is shown in FIG. 4, but including the product display belt 104 mounted therein. As shown in FIGS. 3C and 3D, the left and right lower rails 338, 340 may extend sufficiently far away from the respective inside surfaces of the left and right side walls 304, 302 and towards each other to support and retain the product display belt 104 without interfering with a plurality of flaps projecting downwardly from the product display belt 104 through an elongated aperture 342 defined by the left and right lower rails 338, 340. The left and right lower rails 338, 340 may also extend along the bottom surface 336 of the body 102, from the back wall 306 towards the front end 320 of the body 102.

As shown in FIG. 3D, the left and right lower rails 338, 340 may be further configured to guide the product display belt 104 around a turning point (the location of which is labeled 344) within the interior of the body 102. This may be accomplished by having left and right lower rails 338, 340 curve upwards toward the top wall 300, e.g., in a U-shape, along the respective inside surfaces of the left and right side walls 304, 302. The turning point 344 is positioned near the front end 320 of the body 102. Translation of the product display belt 104 in the forward direction (+) and around the turning point 344 ultimately sends the product display belt 104 towards the back wall 306.

A left upper rail 346 may be mounted to the inside surface of the left side wall 304 and above the left lower rail 338. Similarly, a right upper rail 348 may be mounted to the inside surface 316 of the right side wall 302 and above the right lower rail 340. The left and right upper rails 346, 348 form an additional track along which an electronic circuit device (or a RFID chip or the like) operatively coupled to the product display belt 104 may be mounted. The left and right upper rails 346, 348 may extend sufficiently far away from the respective inside surfaces of the left and right side walls 304, 302 and towards each other to support and retain the electronic circuit device. The left and right upper rails 346, 348 may also extend parallel to the longitudinal axis 108 along the inside surfaces of the left and right side walls 304, 302 from the back wall 306 towards the front end 320 of the body 102. However, unlike the left and right lower rails 338, 340, the left and right upper rails 346, 348 need not curve upwards toward the top wall 300.

As shown in FIG. 3D, an upper right shelf 350 mounted to the inside surface 316 of the right side wall 302 and extending parallel to the longitudinal axis 108 may be included in the body 102 to support the product display belt 104 as it translates backwards (−) towards the back wall 306. An upper left shelf may be similarly mounted to the inside surface of the left side wall 304.

As shown in FIG. 3D, a right wheel support 352 may be mounted to the inside surface 316 of the right side wall 302. A left wheel support may be similarly mounted to the inside surface of the left side wall 304. The right 352 and left wheel supports may extend sufficiently far away from the respective inside surfaces of the right and left side walls 302, 304 and towards each other so as to contact each other when the right and left shells 308, 310 are mounted together. The right 352 and left wheel supports may be mounted to each other via snap fastening as described above with respect to the tab/notches of the right and left shells 308, 310, although other mounting mechanisms may be used. The right 352 and left wheel supports form an axle about which a wheel 1002 (see FIG. 10) may be releasably mounted to freely rotate. The right 352 and left wheel supports and the wheel 1002 mounted thereon may be centered at the turning point 344. The product display belt 104 may make contact with an outer surface 1004 of the wheel 1002 and the two components may move together as the product display belt 104 translates around the turning point 344. Although the wheel 1002 facilitates the translation of the product display belt 104 around the turning point 344, the wheel 1002 (and thus the right 352 and left wheel supports) are not required.

FIGS. 5A-5B show additional details of the product display rail 106. FIG. 5A is a perspective view and FIG. 5B is a left side view. The product display rail 106 is configured to support a linear array of products hanging thereon. The product display rail 106 may include a hanging portion 500. The product display rail 106 may be mounted to the body 102 such that the hanging portion 500 is positioned below the bottom surface 336 of the body 102 and centered between the right and left side walls 302, 304. (See FIG. 1.) The hanging portion 500 may extend from the back wall 306 to the front end 320 approximately parallel to the longitudinal axis 108 of the body 102. In the illustrative embodiment, the hanging portion 500 is a rod having a circular cross-section, but this structure is not limiting. Other elongated structures having different cross-sectional shapes, e.g., rectangle, square, triangle, etc. may be used depending upon the products to be hung. Similarly, the hanging portion 500 may formed to have a bend 502 at a free end 504 from which products are removed, but neither the shape of the bend 502 nor its presence is required. In the illustrative embodiment, the hanging portion 500 is approximately the same length as the body 102. However, in other embodiments, the hanging portion 500 may be longer such that it (and the bend 502) projects beyond the front end 320. This is useful to make it easier for customers to replace removed individual products back onto the hanging portion 500.

It is noted that the product display rail 106 and its hanging portion 500 is a distinct component separate from the product display belt 104. Similarly, the product display rail 106 has a function (support a plurality of hanging products) separate and distinct from the product display belt 104 (separate/divide the plurality of hanging products).

The product display rail 106 may include a mounting portion 506 configured to mount to the body 102 and, in embodiments, also to mount to the display panel. The mounting portion 506 may include a rod 508 extending upwardly, e.g., perpendicularly upwards, from an end opposite the free end 504 of the hanging portion 500. Here, the term "rod" is not meant to be limiting and other elongated structures having different cross-sectional shapes may be used. As described above with respect to the body 102, the crossbar 510 connecting the panel mounting hooks 512, 514 may be mounted to an upper end of the rod 508. These panel mounting hooks 512, 514 may be releasably inserted into holes of a perforated panel to position the product display assembly 100 approximately perpendicular to the plane defined by the perforated panel. The right and left upper hooks 328, 330 of the body 102 may fit over the crossbar 510 so as to releasably mount the product display rail 106 to the body 102. The additional crossbar 516 may be mounted to the rod 508 below the upper end. The right and left lower hooks 332, 334 of the body may fit over the additional crossbar 516 for additional security.

Figure 6A:
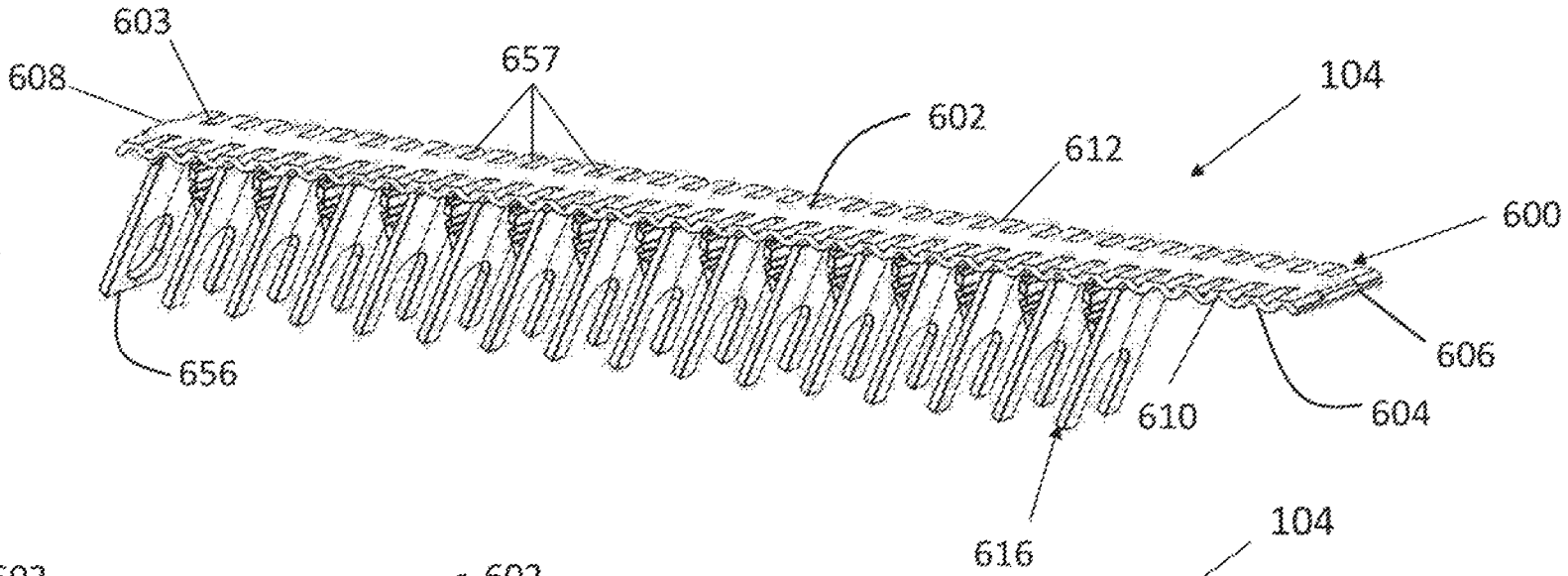
FIG. 6A depicts a perspective view of a product display belt of the product display assembly of FIG. 1.
Figure 6B:
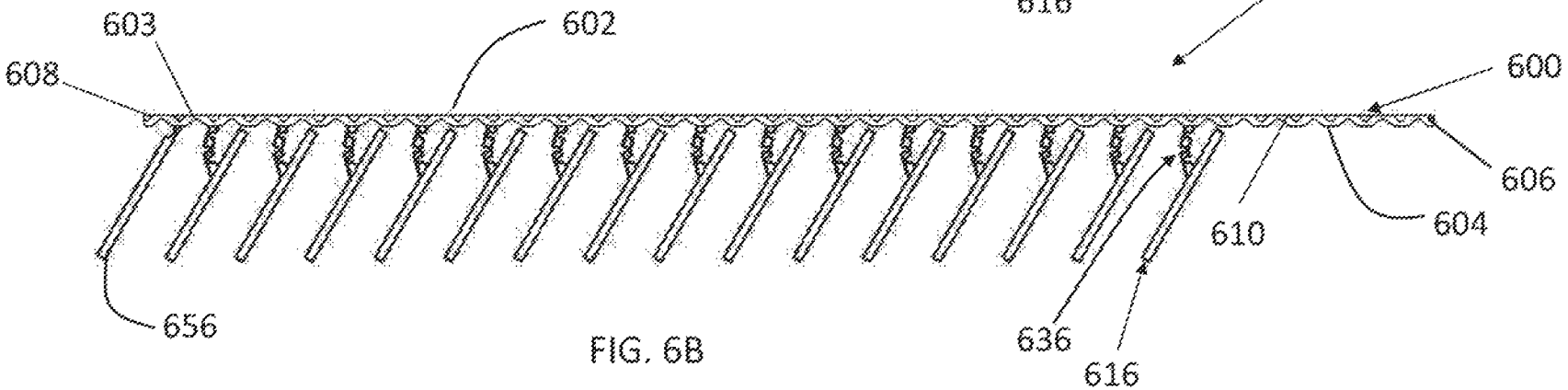
FIG. 6B depicts a left side view of the product display belt of FIG. 6A.
Figure 6C:
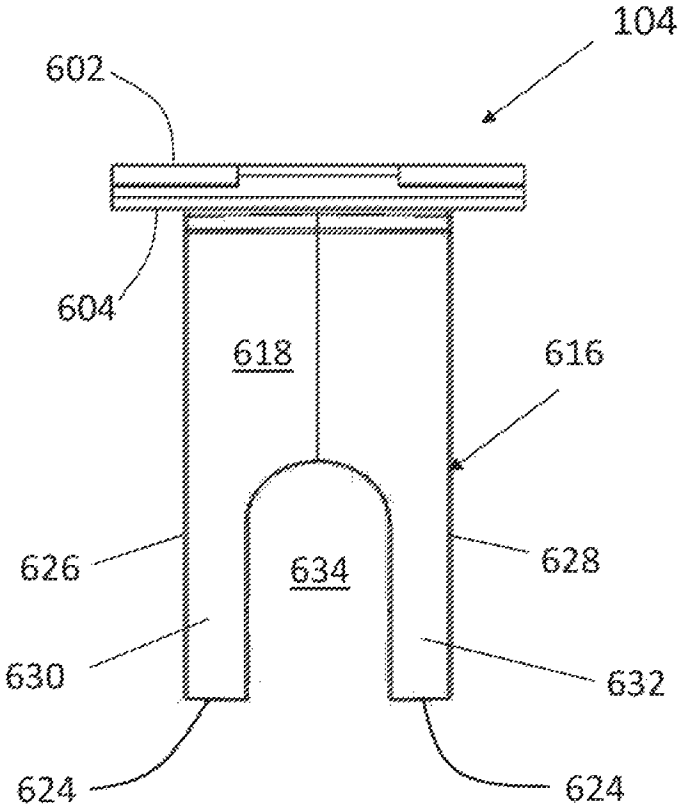
FIG. 6C depicts a front view of a flap of the product display belt of FIG. 6A.
Figure 6D:
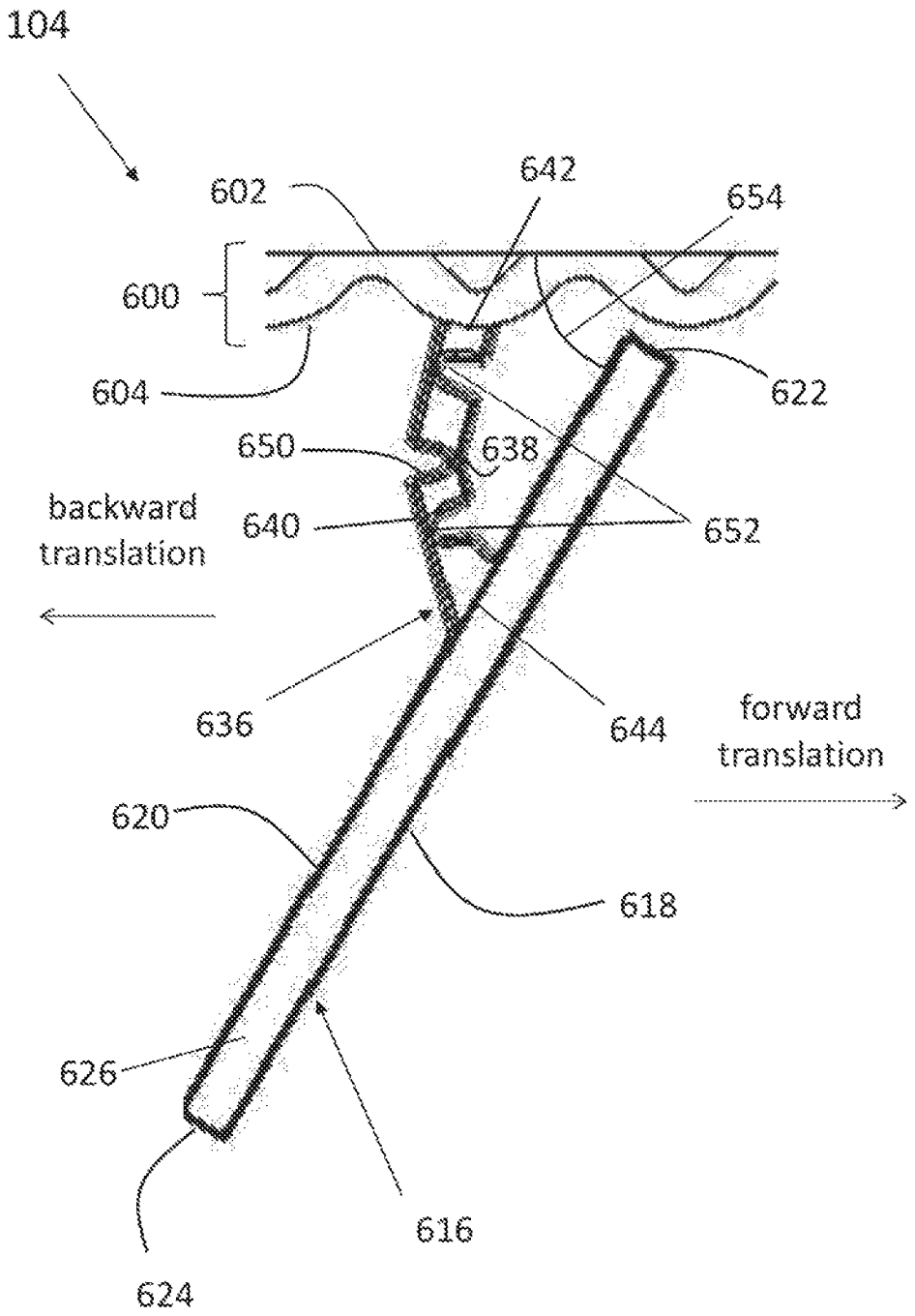
FIG. 6D depicts a left side view of the flap of FIG. 6C.

FIGS. 6A-6D show additional details of the product display belt 104. FIG. 6A shows a perspective view. FIG. 6B shows a left side view. FIG. 6C shows a front view of an individual flap 616 of the product display belt 104. FIG. 6D shows a left side view of the individual flap 616. The product display belt 104 is configured to facilitate the loading and unloading of products onto the product display rail 106. Regarding loading, unlike conventional product display assemblies, (e.g., those described in U.S. Pat. No. 6,539,280 and U.S. Pat. Pub. No. 20090212064) multiple products (e.g., 2, 10, 15, 20, etc.) can be loaded onto the product display rail 106 as a single unit instead of having to load the products individually, one at a time. However, regarding unloading, the product display belt is configured so that individual products are unloaded individually, one at a time. Unlike conventional product display assemblies, the unloading of individual products may be accomplished by simply pulling the individual product in the forward direction (+) instead of also having to lift the individual product upwards.

The product display belt 104 may include a strip 600 having a top surface 602, a bottom surface 604, a front surface 606, a back surface 608, a left side surface 610 and a right side surface 612. The product display belt 104 may further include a plurality of flaps (one individual flap 616 is labeled) mounted to the bottom surface 604 and projecting downwardly away from the bottom surface 604. With respect to flap 616, the flap may have a front facing surface 618, a back facing surface 620, a top surface 622, a bottom surface 624, a left side surface 626 and a right side surface 628. The flap 616 may be mounted such that the back facing surface 620 faces towards the back wall 306 of the body 102 (and thus, towards a back end 603 of the strip 600) and the front facing surface 618 faces towards the front end 320 of the body 102 (and thus, towards a front end of the strip 600). The top surface 622 faces towards the bottom surface 336 of the body 102 and the bottom surface 624 faces towards the hanging portion 500 of the product display rail 106. Other flaps of the plurality of flaps may be similarly configured.

The flaps of the plurality of flaps serve as separators or dividers between adjacent products hung on the product display rail 106. The flaps may be spaced at regular intervals along the longitudinal dimension of the strip 600. The dimension of the spacings are not particularly limited, but rather may depend upon the dimensions of the products to be displayed. The flaps also provide resistance against forward translation (+) of an individual product. Thus, although the dimensions of the flaps and the outer shape of the flaps is not particularly limited, the dimensions and outer shape are generally selected to provide a sufficient amount of overlapping surface area between the outer surfaces of an individual product and the front and back facing surfaces of the flaps in order to achieve these functions. In the illustrative embodiment, the flaps are shaped as two-pronged forks. Using flap 616 as an example, a left prong 630 and a right prong 632 extend downwardly and define a recess 634 in between.

Figure 7B:
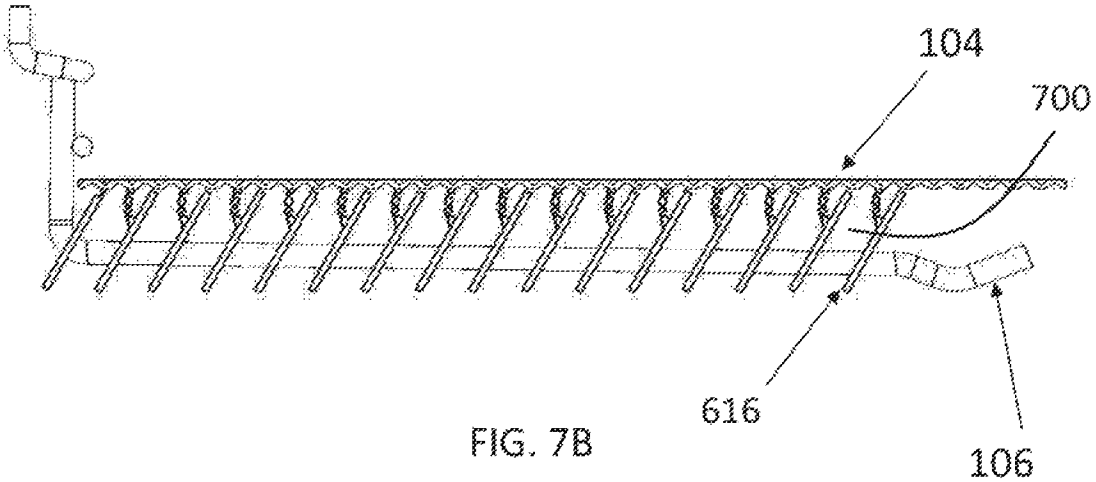
FIG. 7B depicts a left side view of the product display rail and the product display belt of FIG. 1.
Figure 7A:
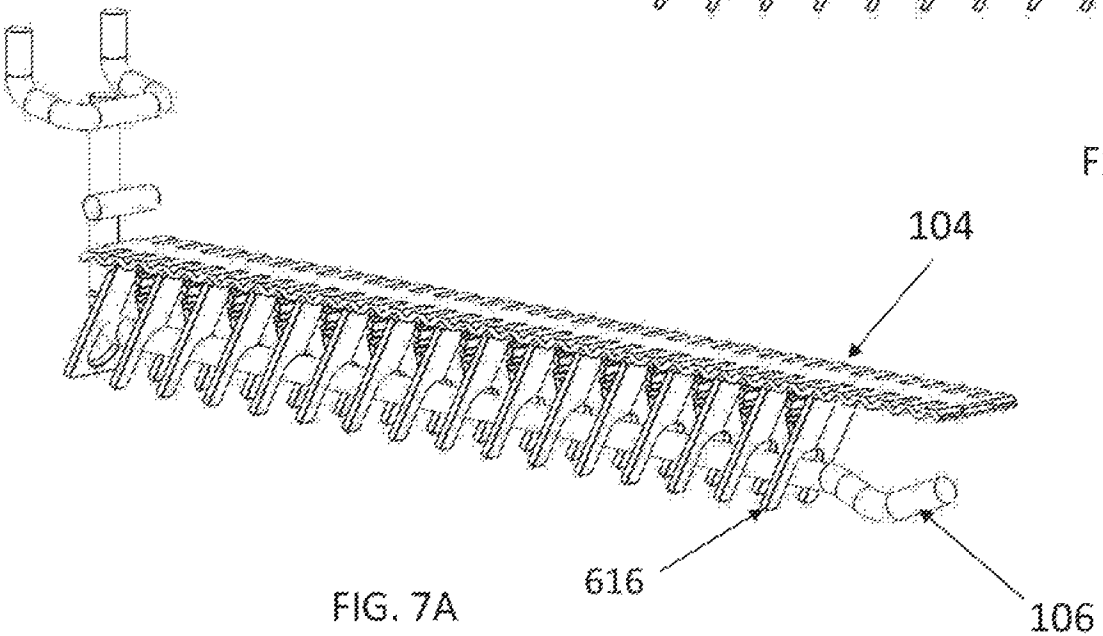
FIG. 7A depicts a perspective view of the product display rail and the product display belt of FIG. 1.

As shown in FIGS. 7A and 7B, showing a perspective view (FIG. 7A) and a left side view (FIG. 7B) of the product display rail 106 and the product display belt 104, the hanging portion 500 of the product display rail 106 passes through the recesses of the flaps and the left and right prongs of the flaps extend along both sides of the hanging portion 500 to below a bottom surface of the hanging portion 500. This forms a linear array of product enclosures (one such product enclosure 700 is labeled in FIG. 7B) along the hanging portion 500. Depending upon the number of products loaded onto the product display rail 106, each product enclosure may contain an individual hanging product.

Figure 8:
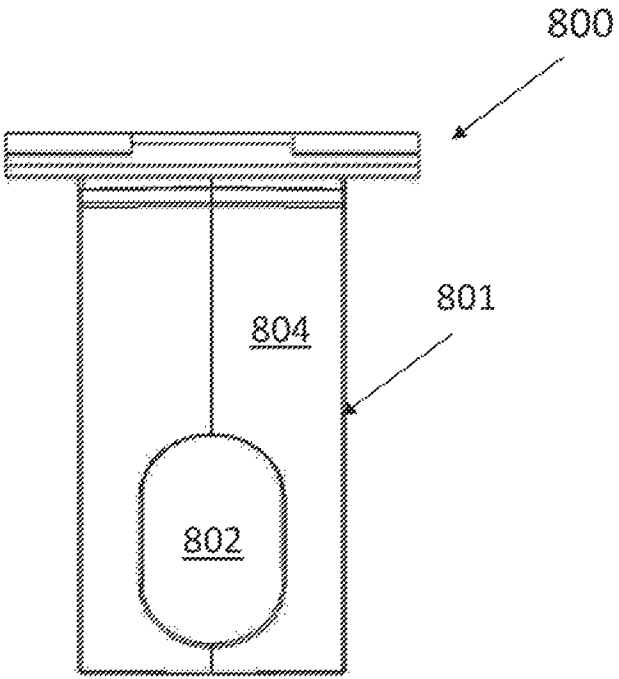
FIG. 8 depicts a front view of a flap of another product display belt according to an illustrative embodiment.

An alternative embodiment of a flap 801 on an alternative product display belt 800 is shown in FIG. 8. In this embodiment, the flap 800 is shaped as a loop defining an opening 802 extending from a front facing surface 804 to a back facing surface. The dimension and shape of the opening 802 is not particularly limited provided the hanging portion 500 of the product display rail 106 can pass through. This flap configuration is useful to provide additional security against unauthorized removal of individual products since it is difficult to pull a product under the flap (as compared to pulling a product under open prongs of a fork-shaped flap). The outer shape of the flap 801 is also not particularly limited.

As noted above, the outer shapes of the flaps are not particularly limited. However, in the illustrative embodiments, the front and back facing surfaces of the flaps are substantially flat, i.e., free of projections mounted to and extending away from these surfaces.

Turning back to FIGS. 6A and 6B, each flap may be mounted to the bottom surface 604 of the strip 600 via an associated hinge (one of which is labeled 636). Each hinge is configured to allow a relatively large range of motion with minimal resistance of the associated flap in the backwards direction (−) but a relatively small range of motion with greater resistance of the associated flap in the forward direction (+). As shown in FIG. 6D, with respect to hinge 636, the hinge may have a front facing surface 638, a back facing surface 640, a top surface 642, a bottom surface 644, a left side surface and a right side surface. The back facing surface 640 may face the back wall 306 of the body 102 while the front facing surface 638 faces the front end 320 of the body 102. The top surface 642 of the hinge 636 may be mounted to the bottom surface 604 of the strip 600 and the bottom surface 644 of the hinge may be mounted to the back facing surface 620 of the flap 616. Thus, in the illustrative embodiment, the hinge 636 is mounted below the top surface 622 of the flap 616 leaving a free top end of the flap 616. Each hinge may be similarly configured.

This hinge mounting configuration allows each flap to be pushed in the backwards direction (−) over a relatively large angular distance, including until an individual flap is approximately parallel to the strip 600. This greatly facilitates the loading of multiple products as a single unit as noted above. That is, multiple products in a linear array can be loaded as a single unit by placing the last product of the unit on the hanging portion 500 of the product display rail 106 and pushing the unit backwards (−) until all products are loaded. During this process, each hinge allows each flap to be pushed backwards (−) with little resistance. After loading, gravity pulls the flaps downward to settle between the gaps between neighboring products.

At the same time, this hinge mounting configuration allows each flap to be pulled in the forward direction (+) over a smaller angular distance. Using flap 616 as an example, this is because the top surface 622 of the flap 616 at its free end will make contact with the bottom surface 604 of the strip 600, thereby resisting and blocking any further movement of the flap 616. Instead, further forward translation pulls the entire product display belt 104 forward within the track of the body 102. Only as the flap 616 (and the strip 600 to which the flap 616 is mounted) turns around the turning point 344, does the forward translation allow the product to be released from the free end 504 of the product display rail 106. In addition, although not shown in the illustrative embodiment, each flap may include a foot formed from an additional bead (or ridge) of material mounted to the top surface of the flap to provide additional friction and resistance against forward translation and to further reduce the angular distance upon pulling in the forward direction. (See FIG. 14B, further described below).

The angular distances described above may be defined with respect to a flap angle 654 shown in FIG. 6D. The flap angle 654 may be defined as the angle formed by the intersection of the plane defined by the strip 600 and the back facing surface 620 of the flap 616. The flap angle 654 refers to the flap in a static, freely hanging condition. By contrast, during use, i.e., as product is being loaded on or unloaded off the product display assembly 100, the flap angle 654 will change since the flap is pushed backwards (loading) or pulled forwards (unloading). Specifically, the flap angle 654 will decrease as product is being loaded and the flap angle 654 will increase as product is being unloaded. The magnitude of the decrease or increase, measured in degrees, corresponds to the angular distances described above. As described above, the hinge mounting configuration may be such that each flap may be pushed backwards over a greater angular distance (e.g., greater than 10°, 20°, 45°, etc.) but pulled forwards over a smaller angular distance (e.g., no more than 10°, 5°, 2°, etc.).

As shown in FIG. 6D, the hinge 636 may include an elongated notch 650 formed in the back facing surface 640 which extends from the left side surface to the right side surface of the hinge 636. The hinge 636 may also include two elongated notches 652 formed in the front facing surface 638, each extending from the left side surface to the right side surface and approximately parallel to the elongated notch 650. The elongated notches 650, 652 may distributed along the length of the hinge 636 providing an upper notch closest to the strip 600, a middle notch and a lower notch closest to the flap 616. Each hinge may be similarly configured.

The dimensions and outer shape of the hinges are not particularly limited. However, the dimensions of the hinges may be selected to provide a desired flap angle. As described above, the flap angle 654 may be defined as the angle formed by the intersection of the plane defined by the strip 600 and the back facing surface 620 of the flap 616. The flap angle 654 is not particularly limited, but rather depends upon the dimensions of the hinge 636 as well as the mounting position of the hinge 636 on the back facing surface 620 of the flap 616. However, the angle 654 is generally greater than 0° (defined as when the strip 600 and the flap 616 are oriented parallel to one another) since at this angle the flap 616 would be an ineffective separator/divider. Similarly, the angle 654 is generally smaller than 90° (defined as when the strip 600 and flap 616 are oriented perpendicular to one another). In the illustrative embodiment, the angle is approximately 45°. Each flap/hinge may be similarly configured.

As shown in FIGS. 6A and 6B, in addition to the plurality of flaps, the product display belt 104 may further include a guide flap 656 having a different configuration from the flaps of the plurality of flaps and configured to facilitate loading of the product display belt 104 onto the hanging portion 500 of the product display rail 106. Although the outer shape of the guide flap 656 is not particularly limited, in the illustrative embodiment the guide flap 656 is a rectangular shaped loop defining an opening through which the hanging portion 500 of the product display rail 106 may be inserted. That is, the guide flap 656 may be similarly configured to the flap 801 shown in the illustrative alternative embodiment of FIG. 8. The guide flap 656 may be positioned at or near the back end 603 of the strip 600.

As shown in the illustrative embodiment, the top surface 602 of the strip 600 may include a plurality of divots 657 (a few of which are labeled in FIG. 6A). These divots 657 may be configured (i.e., shape, position, dimensions) to mate with teeth 1006 on an outer surface 1004 of the wheel 1002 as further described below. (See FIG. 10.) The bottom surface 604 of the strip 600 is corrugated, which is useful to impart flexibility to the strip 600. However, these configurations are neither necessary nor limiting. By way of illustration, the top surface 602 of the strip 600 as well as the outer surface 1004 of the wheel 1002 may be smooth.

A portion of the strip 600 at or near the back end 603 may be colored differently from the remaining portion of the strip 600. By way of illustration, the portion of the strip 600 near the back end 603 may be colored red, while the remaining portion of the strip 600 is clear or white. The emergence of the colored portion at the front end 320 of the body 102 as the product display belt 104 is pulled forward may be useful to indicate that the product display belt 104 is near its end.

Figure 9B:
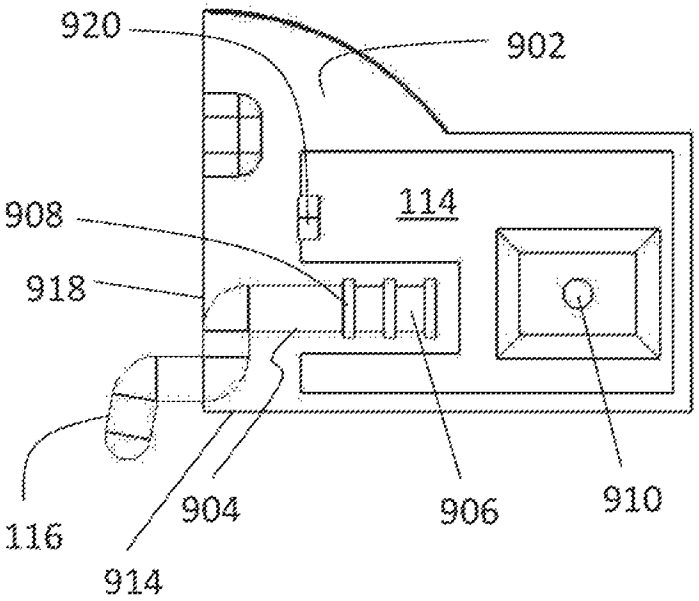
FIG. 9B depicts a left side view of a right security panel and a panel mounting hook mounted thereon of the product display assembly of FIG. 1.
Figure 9A:
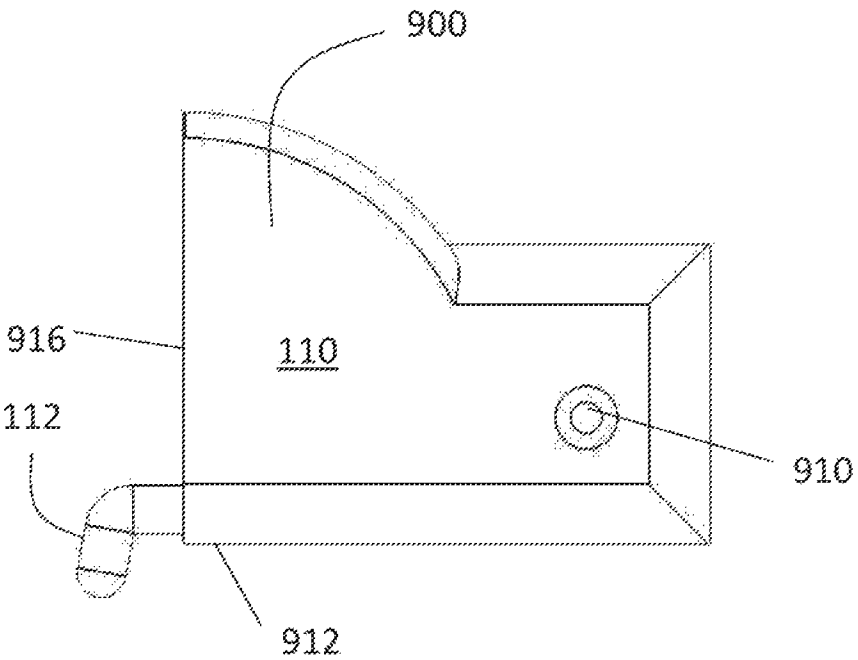
FIG. 9A depicts a left side view of a left security panel and a panel mounting hook mounted thereon of the product display assembly of FIG. 1.

Although not required, the product display assembly 100 may include additional components configured to provide security against unauthorized removal of products or of the entire product display assembly 100. As shown in FIG. 1, these additional components may include a left security plate 110, a left panel mounting hook 112, a right security plate 114 and a right panel mounting hook 116 (see FIG. 9B). These left and right security plates 110, 114 and left and right panel mounting hooks 112, 116 are configured to lock the product display assembly 100 onto the display panel. These additional components are shown in greater detail in FIGS. 9A and 9B. FIG. 9A shows a left side view of the left security plate 110 and the left panel mounting hook 112 mounted thereon. FIG. 9B shows a left side view of the right security plate 114 and the right panel mounting hook 116 mounted thereon.

An outer surface 900 of the left security plate 110 is shown in FIG. 9A (an outer surface of the right security plate 114 may be similarly configured). An inside surface 902 of the right security plate 114 is shown in FIG. 9B (an inside surface of the left security plate 110 may be similarly configured). The outer shapes and dimensions of the left and right security plates 110, 114 are not particularly limited, but may be selected depending upon the dimensions of the body 102.

The right panel mounting hook 116 may be mounted to the inside surface 902 of the right security plate 114. Various mounting configurations may be used, e.g., a channel 904 may be formed in the inside surface 902 to receive an end 906 of the right panel mounting hook 116. A plurality of brackets (one is labeled 908) may be mounted to the inside surface 902 to further secure the end 906 of the right panel mounting hook 116. The left panel mounting hook 112 may be similarly mounted to the inside surface of the left security plate 110.

As shown in FIG. 1, the left and right security plates 110, 114 may be mounted to the outer surfaces of the left and right side walls 304, 302 of the body 102, respectively, near the back wall 306. Various mounting configurations may be used, e.g., via screws (one is labeled 118) to be inserted through holes 910 (see FIGS. 9A and 9B) defined in the left and right security plates 110, 114 and through holes 354 (see FIGS. 3B and 3D) defined in the left and right side walls 304, 302. The screws may be security screws having heads that can only be unscrewed using a security screwdriver. Tapped inserts may fit over the opposing ends of the screws projecting into the interior of the body 102. Alignment of the left and right security plates 110, 114 to the body 102 may be facilitated by tabs (one tab 920 is shown in FIG. 9B) mounted to the inside surfaces of the left and right security plates 110, 114. The tabs may fit into additional holes 356 (see FIGS. 3B and 3D) defined in the left and right side walls 304, 302.

The left and right panel mounting hooks 112, 116 may be positioned near bottom surfaces 912, 914 of the left and right security plates 110, 114, respectfully. The left and right panel mounting hooks 112, 116 may project away from back surfaces 916, 918 of the left and right security plates 110, 114, respectfully. The left and right panel mounting hooks 112, 116, however, may extend in the opposite direction (e.g., downwardly) as compared to the panel mounting hooks 512, 514 of the product display rail 106 (see FIG. 1). In this way, the left and right security plates 110, 114 and their oppositely extending panel mounting hooks 112, 116 serve as lock since the product display assembly 100 cannot be removed from the display panel unless the left and right security plates 110, 114 are removed first.

Other configurations may be used for the security plates and associated panel mounting hooks. By way of illustration, a single security plate or cap may be used with or without associated panel mounting hooks mounted thereon.

Figure 10:
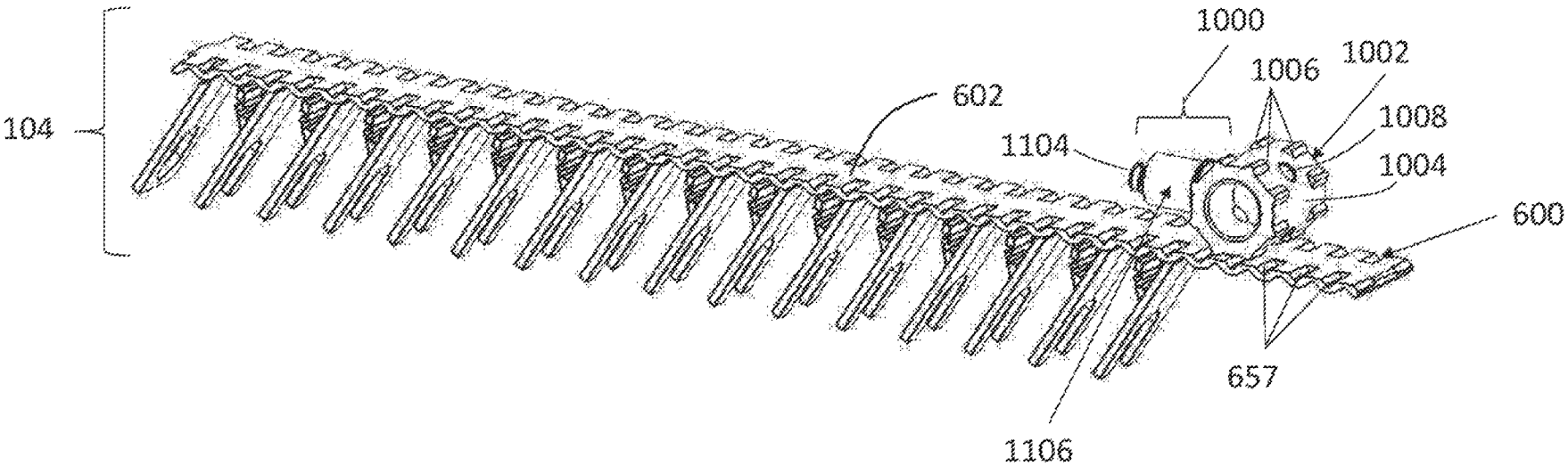
FIG. 10 depicts a perspective view of the product display belt, a wheel and a wheel locking assembly of the product display assembly of FIG. 1.
Figure 11:
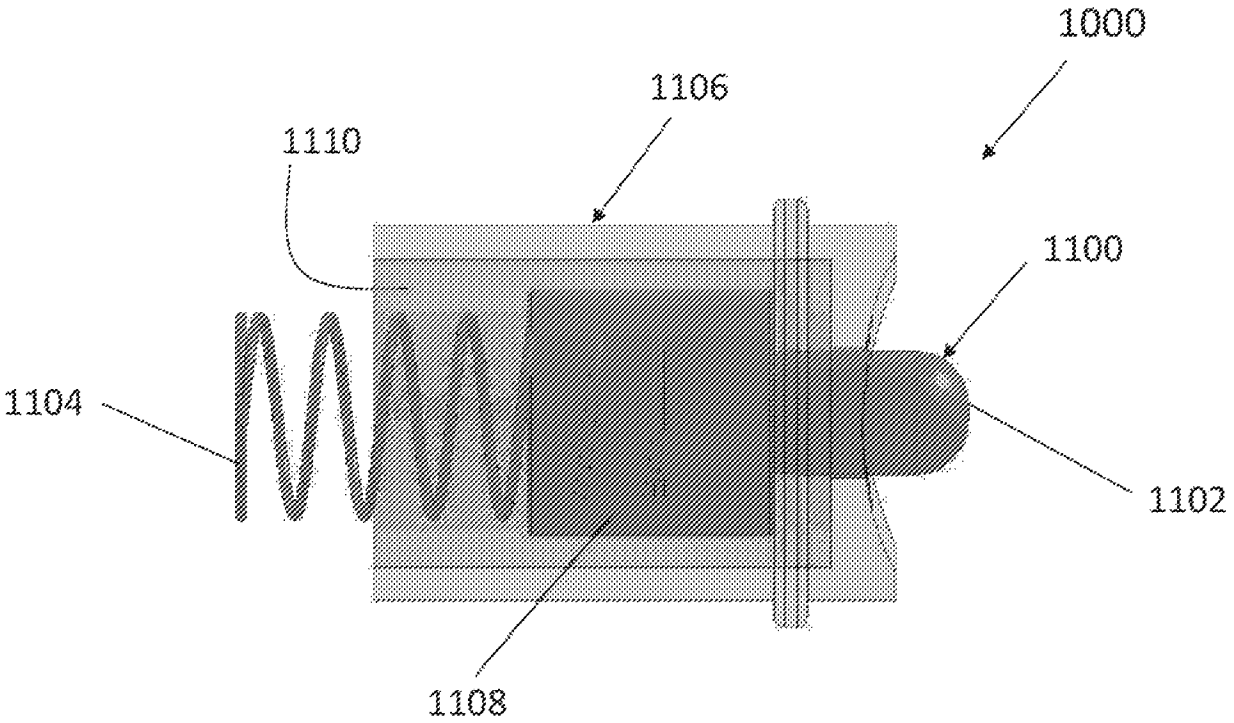
FIG. 11 depicts a transparent, left side view of the wheel locking assembly of FIG. 10.

As shown in FIGS. 10 and 11, the product display assembly 100 may include a wheel locking assembly 1000. FIG. 10 shows a perspective view of the product display belt 104 of the product display assembly 100, the wheel 1002, and the wheel locking assembly 1000. FIG. 11 shows a transparent, left side view of the wheel locking assembly 1000. The wheel locking assembly 1000 is configured to lock the wheel 1002 against the top surface 602 of the strip 600 of the product display belt 104. In this way, the wheel locking assembly 1000 prevents translation of the product display belt 104 and thus, removal of product from the product display rail 106.

As described above, the wheel 1002 may be mounted on the right 352 and left wheel supports of the body 102 and positioned in the interior of the body 102. The outer surface 1004 of the wheel 1002 may include teeth 1006 which mate with divots 657 on the top surface 602 of the strip 600 of the product display belt 104. The outer surface 1004 of the wheel 1002 may include one or more holes 1008 defined therein. The holes 1008 may receive an end 1102 of a piston 1100 of the wheel locking assembly 1000.

The wheel locking assembly 1000 may include the piston 1100, a spring 1104 and a sleeve 1106. As shown in FIG. 11, the piston 1100 may be mounted to the spring 1104 at an opposing end 1108 or within an interior of the piston 1100. The piston 1100 and the spring 1104 may be mounted in an interior 1110 of the sleeve 1106 such that only the end 1102 of the piston 1100 extends out of the sleeve 1106. The force of the spring 1104 pushes the end 1102 of the piston 1100 into one of the holes 1008 of the wheel 1002. This locks the wheel 1002, preventing its rotation about the axle provided by the right 352 and left wheel supports. This, in turn, prevents the product display belt 104 from translating and thus, prevents removal of product from the product display rail 106. The wheel 1002 may be unlocked by retracting the spring 1104/piston 1100. This may be accomplished by forming the spring 1104 or piston 1100 or both out of a magnetic material and placing a security magnet at an appropriate location near the spring 1104/piston 1100.

The dimensions of the wheel 1002 and the dimensions of the wheel locking assembly 1000 and its outer shape are not particularly limited, but rather depend upon the dimensions of the product display belt 104 and the body 102.

Other configurations may be used for the wheel locking assembly 1000 may be used.

As described above, the product display assembly 100 may include the electronic circuit device, e.g., mounted to the additional track in the body 102. The electronic circuit device (or RFID chip or the like) may be configured to provide electronic product identification and monitoring for the product display assembly 100. This can include information about the type of product being displayed, the maximum capacity of an individual product display assembly, location of the individual product display assembly, current inventory on the individual product display assembly, quantity of product needed to replenish the individual product display assembly, etc. Various configurations may be used, including those described in U.S. Pat. No. 6,539,280. The product display belt 104 may include a magnetic or ferromagnetic material or an electrical contact for position-dependent interaction with the electronic circuit device as described in U.S. Pat. No. 6,539,280 to achieve the electronic product identification and monitoring. The electronic circuit device may also be configured to trigger a security alarm upon unauthorized removal of a product or the entire product display assembly 100 as described in U.S. Pat. No. 6,539,280.

The product display assembly 100 having the electronic circuit device may be included in a merchandise system, e.g., to be used in a retail store. The merchandise system may include a plurality of product display assemblies, each having an electronic circuit device configured as described above, and a controller. If utilizing RF signals, the merchandise system may further include an antenna assembly along with one or more scanners (e.g., handheld scanners) or a central scanning unit and one or more power sources. As is known in the art, the controller may include an input interface, an output interface, a communication interface, a computer-readable medium, a processor, a control application, and a database. The merchandise system may be used to provide electronic product identification and monitoring for each of the product display assemblies in the store as described in U.S. Pat. No. 6,539,280.

U.S. Pat. No. 6,539,280 is hereby incorporated by reference for description related to the electronic circuit device and the merchandise system.

Figure 12:
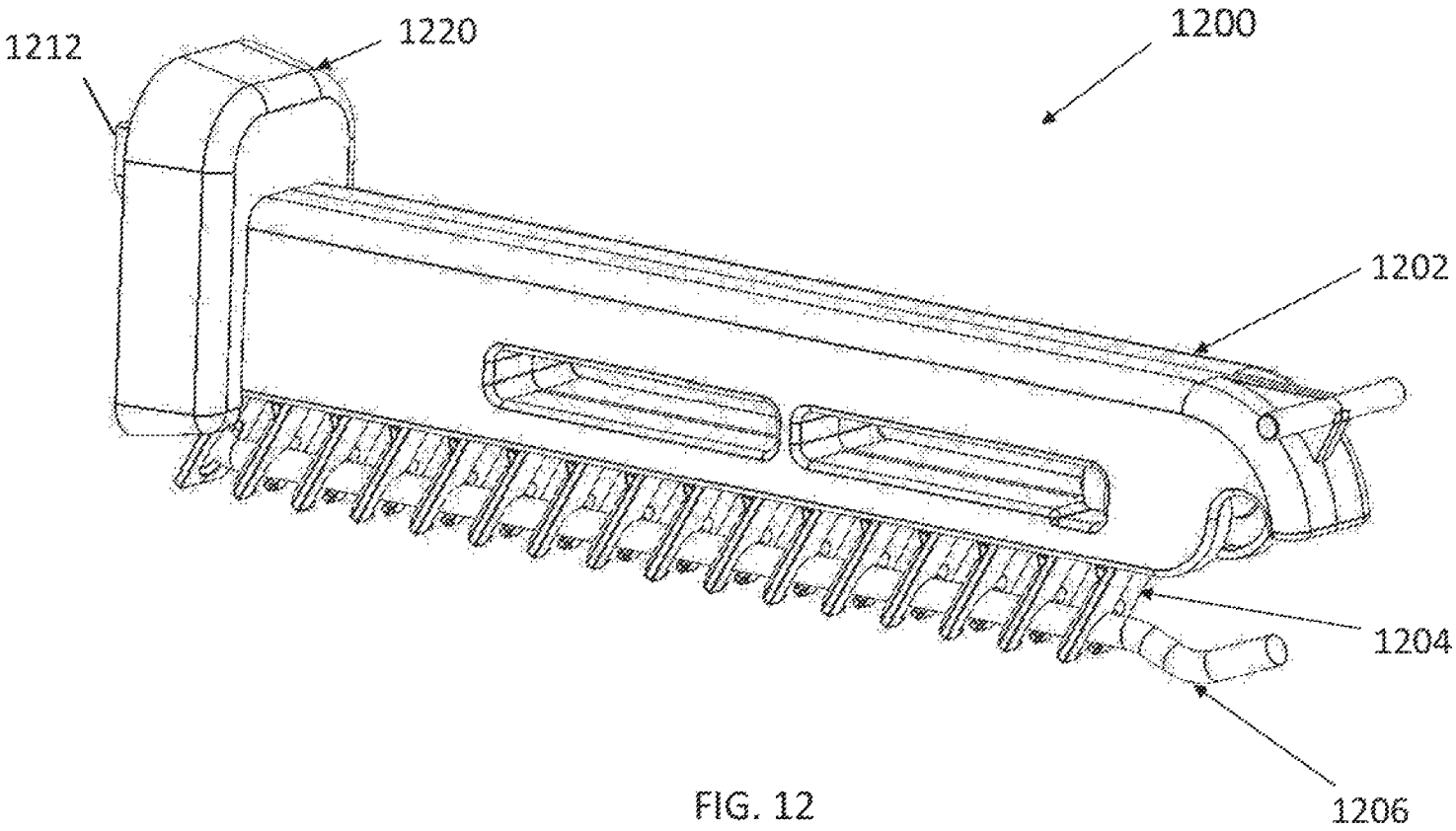
FIG. 12 depicts a perspective view of another product display assembly according to an illustrative embodiment.

FIG. 12 shows a perspective view of another illustrative product display assembly 1200. Like the product display assembly 100 of FIG. 1, product display assembly 1200 includes a body 1202, a product display belt 1204, and a product display rail 1206.

Figure 13:
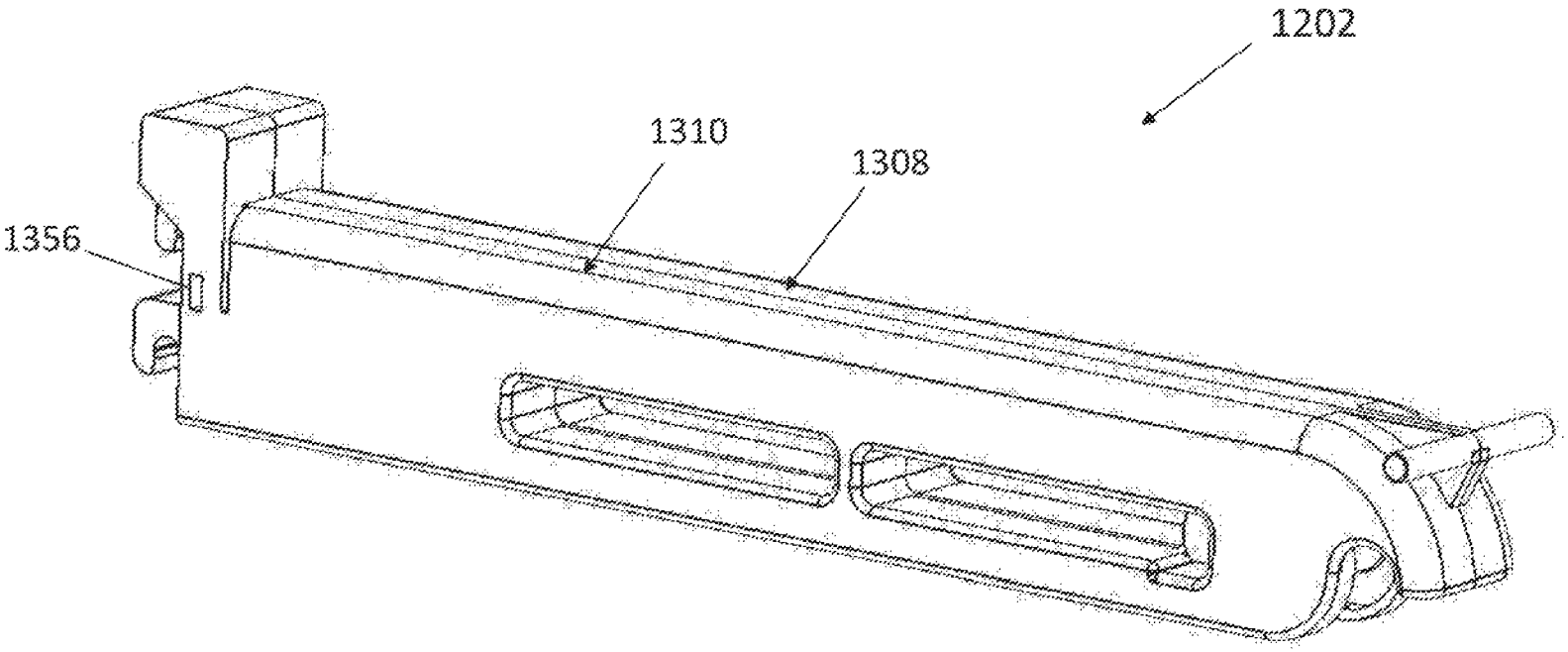
FIG. 13 depicts a perspective view of a body of the product display assembly of FIG. 12.

FIG. 13 shows a perspective view of the body 1202. The body 1202 is formed as two shells, a right shell 1308 and a left shell 1310. The body 1202 is configured identically to the body 102 of the product display assembly 100 (see FIGS. 3A-3D) except for a few differences. Specifically, as compared to the body 102, the outer surfaces of some of the walls of the body 1202 have a different shape and the right and left side walls of the body 1202 define two apertures instead of three.

Figure 17:
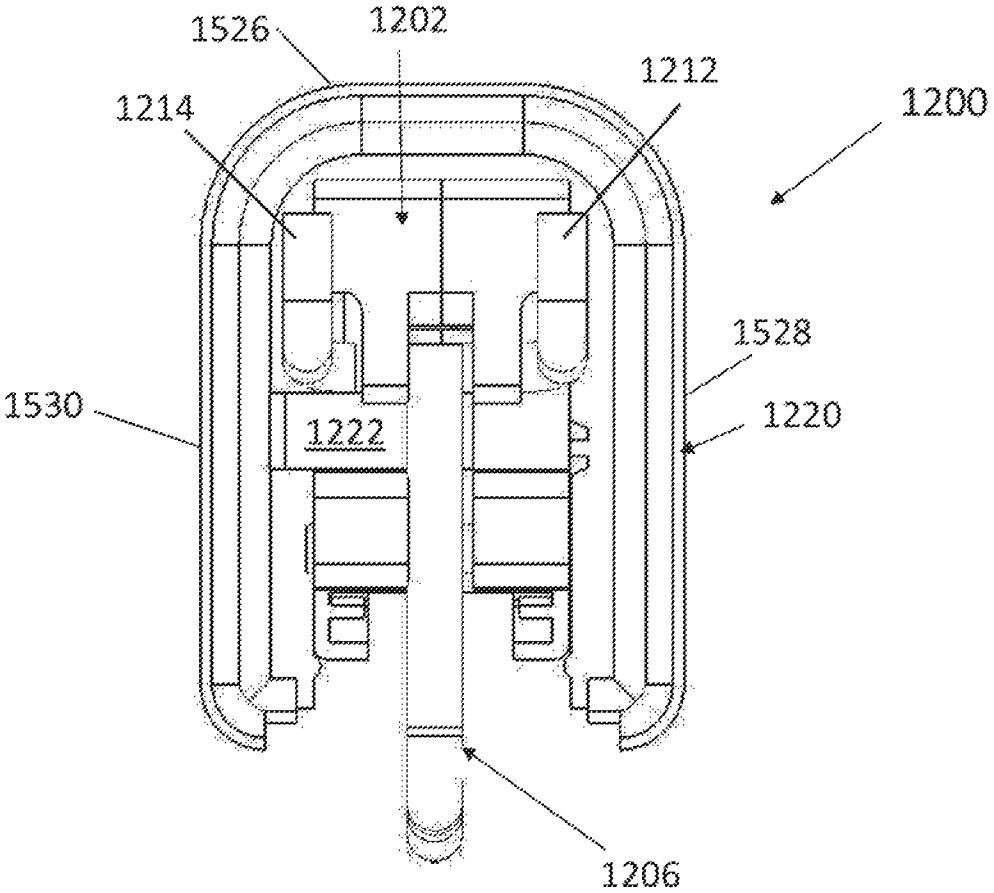
FIG. 17 shows a back view of components of the product display assembly of FIG. 12.

The product display rail 1206 is configured identically to the product display rail 106 of the product display assembly 100 (see FIGS. 5A-5B) and includes panel mounting hooks, a portion of one of which is labeled 1212 in FIG. 12 and the other 1214 in FIG. 17.

Figure 14A:
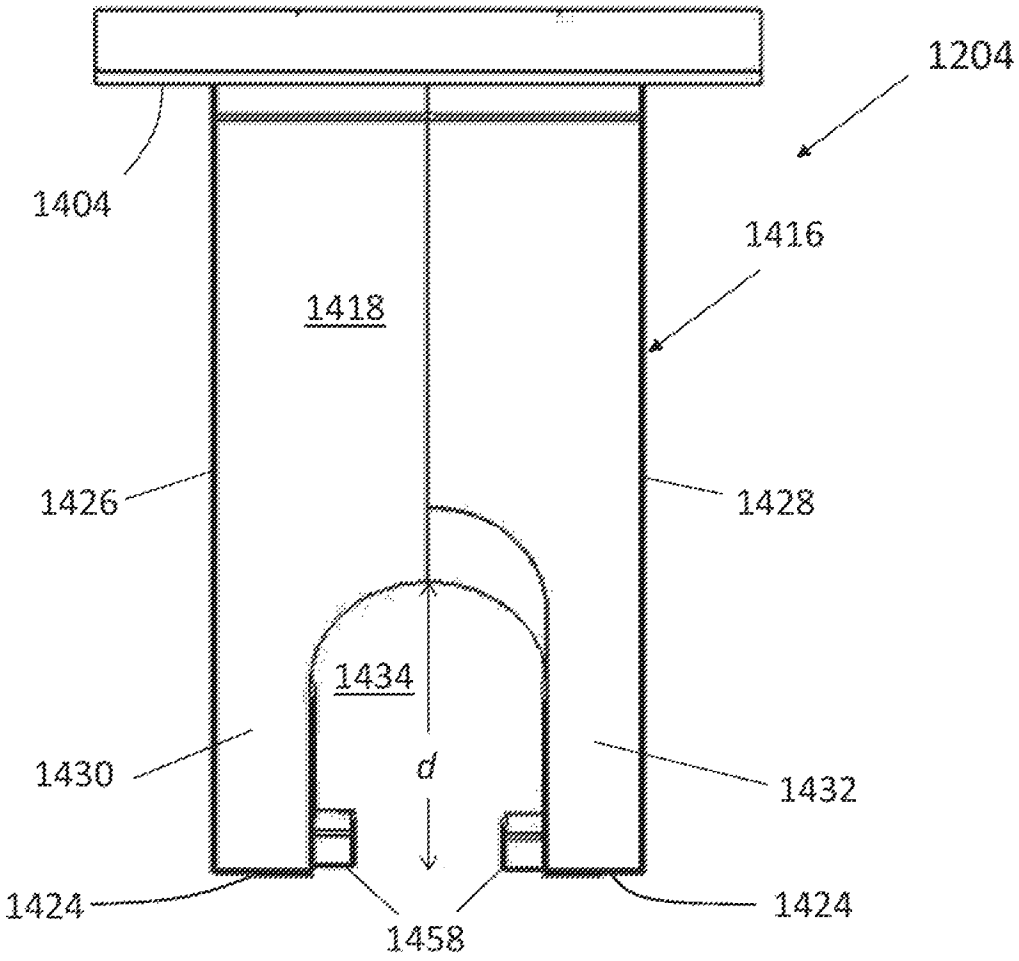
FIG. 14A depicts a front view of a flap of a product display belt of the product display assembly of FIG. 12.
Figure 14B:
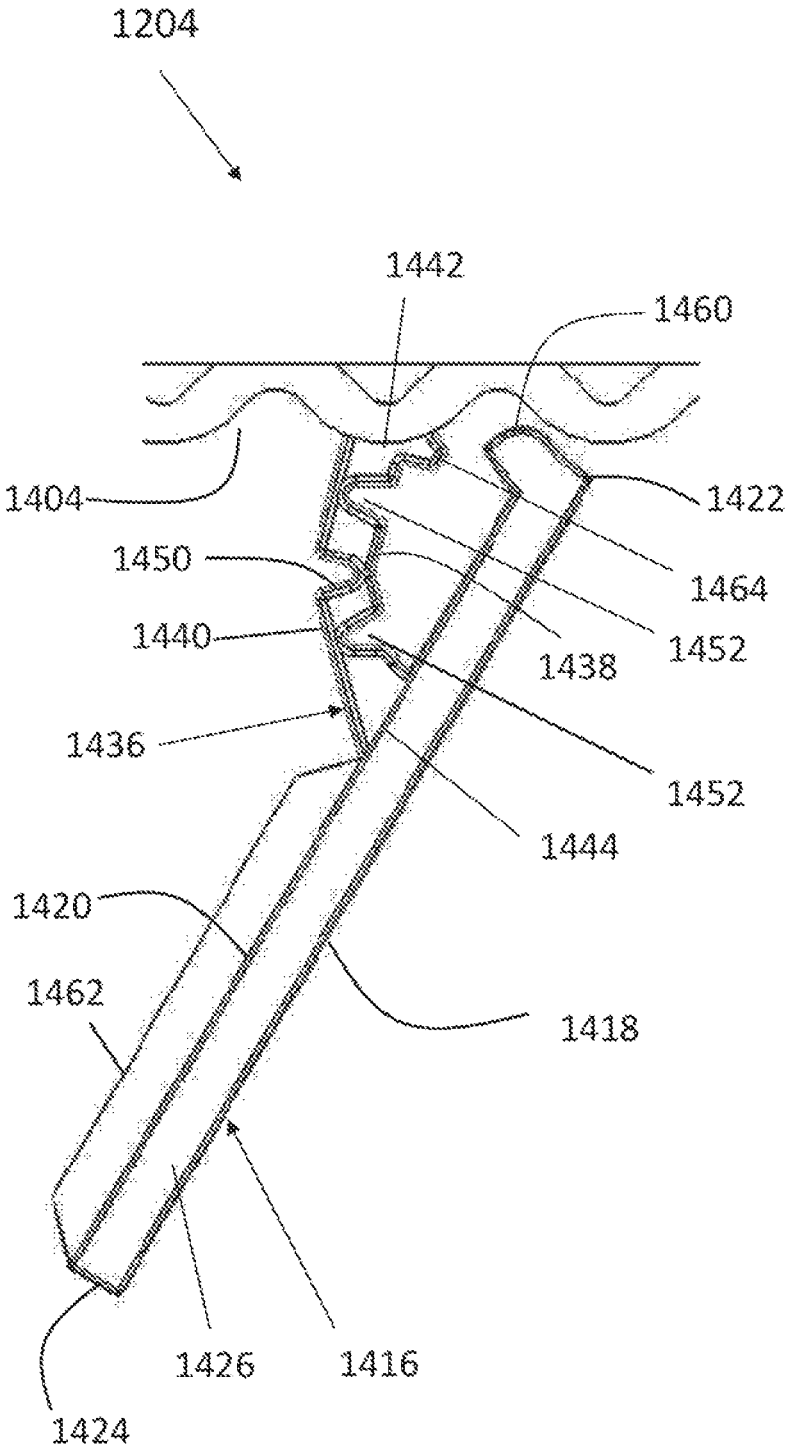
FIG. 14B depicts a left side view of the flap of FIG. 14A.
Figure 14C:
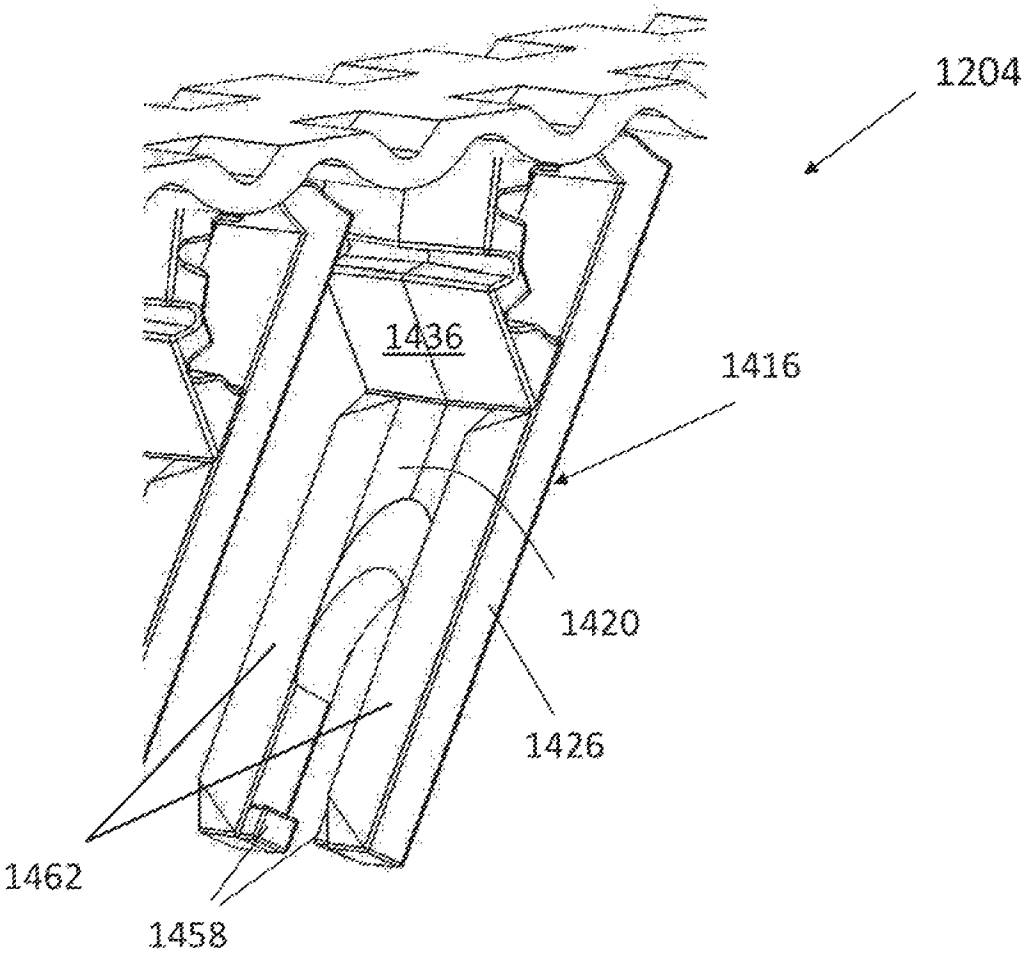
FIG. 14C depicts a perspective view, viewed from the back, of the flap of FIG. 14A.

The product display belt 1204 is configured identically to the product display belt 104 of the product display assembly 100 (see FIGS. 6A-6D) except for differences relating to the plurality of flaps and associated hinges. These differences are shown in FIGS. 14A-14C. FIG. 14A shows a front view of an individual flap 1416 of the product display belt 1204. FIG. 14B shows a left side view of the flap 1416. FIG. 14C shows a perspective view of the flap 1416 angled so as to better view a back facing surface 1420 of the flap 1416. The other flaps of the plurality of flaps of the product display belt 1204 may be similarly configured.

As shown in FIGS. 14A-14C, the flap 1416 has a front facing surface 1418, the back facing surface 1420, a top surface 1422, a bottom surface 1424, a left side surface 1426 and a right side surface 1428. Flap 1416 is shaped as a two-pronged fork having a left prong 1430 and a right prong 1432 extending downwardly to define a recess 1434 in between. However, as compared to the flap 616 of FIG. 6C, the depth d of the recess 1434 is smaller. This means there is a smaller gap (e.g., no gap) between the product display rail 1206 and the plurality of flaps, which provides additional security against unauthorized removal of individual products. In addition, the left and right prongs 1430, 1432 each have a tab 1458 mounted to the surface defining the recess 1434, near the bottom surface 1424 of the flap 1416. The tabs 1458 project away from the surface defining the recess 1434 and towards each other. Again, these tabs 1458 further provide additional security against unauthorized removal of individual products by making it more difficult to pull a product under the flap 1416. The tabs 1458 mean that the ends of the prongs (closest to the bottom surface 1424) are effectively wider than the middles of the prongs. This type of tapering, providing wider ends on the prongs, may be accomplished other ways besides using tabs, e.g., by simply forming the prongs to have the desired shape.

Two other differences of the plurality of flaps of the product display belt 1204 as compared to the product display belt 104 of the product display assembly 100. First, the top surface 1422 includes a ridge 1460 mounted thereon and extending horizontally along the flap 1416 (i.e., along the width of the flap 1416). As described above, such a ridge can act as a foot providing additional friction and resistance against forward translation and further reduces the angular distance the flap 1416 can cover upon pulling in the forward direction. Second, although the front facing surface 1418 is substantially flat, the back facing surface 1420 includes two ridges 1462 mounted thereon and extending vertically along a portion of the flap 1416 (i.e., in a longitudinal direction of the flap 1416). The ridges 1462 are best viewed in the perspective view of FIG. 14C. These ridges 1462 are useful to impart additional rigidity to the flap 1416. Such rigidity also provides additional security against unauthorized removal of individual products. Other configurations may be used to impart rigidity, e.g., by forming flaps to have a plurality of vertically aligned pleats, similar to the pleats in the bellow of an accordion.

Turning back to FIG. 14B, each flap is mounted to a bottom surface 1404 of the product display belt 1204 via an associated hinge (one of which is labeled 1436). The hinge 1436 is configured identically to the hinge 636 (see FIG. 6D) in that it includes a front facing surface 1438, a back facing surface 1440, a top surface 1442, a bottom surface 1444, a left side surface and a right side surface. The hinge 1436 also includes an elongated notch 1450 formed in the back facing surface 1440 which extends from the left side surface to the right side surface of the hinge 1436. The hinge 1436 also includes two elongated notches 1452 formed in the front facing surface 1438, each extending from the left side surface to the right side surface and approximately parallel to the elongated notch 1450. However, as compared to the hinge 636 (see FIG. 6D), the hinge 1436 includes a ridge 1464 mounted to the top surface 1442 and extending horizontally along the hinge 1436 (i.e., along the width of the hinge 1436). The ridge 1464 projects towards the ridge 1460 of the flap 1416. The other hinges of the associated hinges of the product display belt 1204 may be similarly configured.

Figure 15:
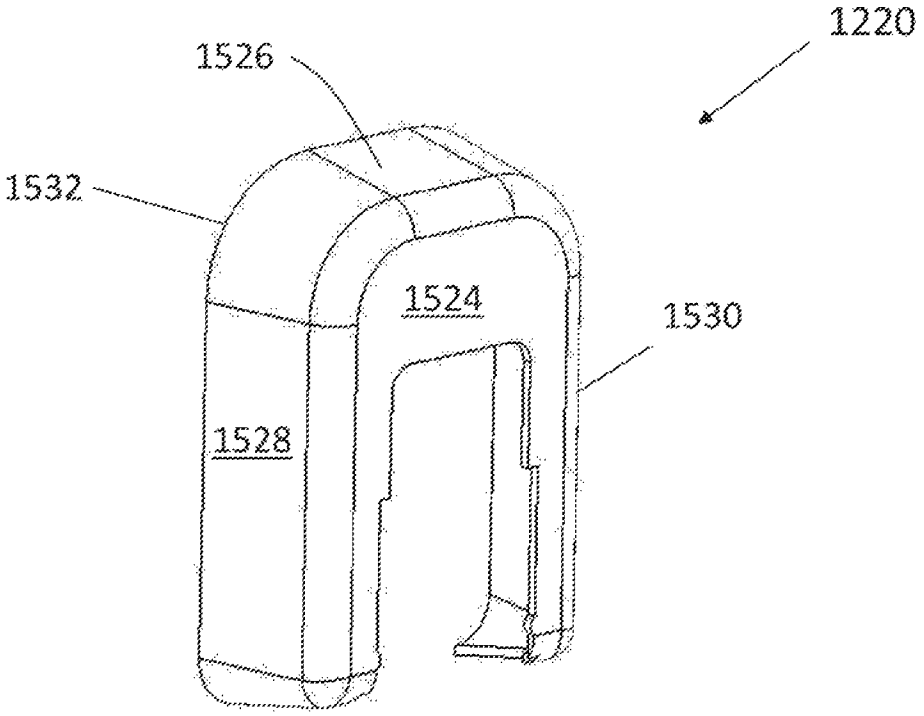
FIG. 15 depicts a perspective view of a cap of the product display assembly of FIG. 12.
Figure 16B:
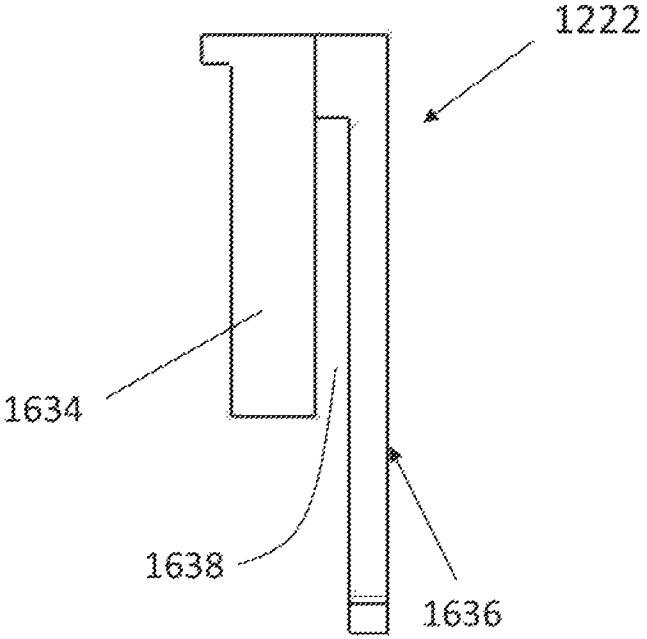
FIG. 16B shows a top view of the clip of FIG. 16A.
Figure 16A:
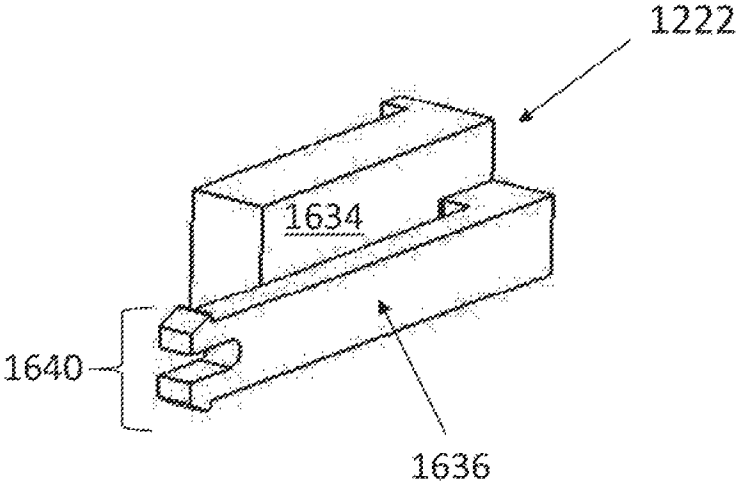
FIG. 16A shows a perspective view of a clip of the product display assembly of FIG. 12.

Turning back to FIG. 12, the product display assembly 1200 includes a cap 1220 and a clip 1222 (see FIGS. 13A, 13B) instead of the left security plate 110, the left panel mounting hook 112, the right security plate 114 and the right panel mounting hook 116 of the product display assembly 100 (see FIGS. 1, 9A, 9B). FIG. 15 shows a perspective view of the cap 1220. FIG. 16A shows a perspective view of the clip 1222. FIG. 16B shows a top view of the clip 1222. FIG. 17 shows a back view of a portion of the product display assembly 1200 (including the body 1202 and the product display rail 1206) in order to illustrate the cap 1220 and the clip 1222 when assembled.

The cap 1220 is configured to fit over a back end of the body 1202. The cap 1220 may include a front wall 1524, a top wall 1526, a left side wall 1528 and a right side wall 1530. The front wall 1524 is shaped to define a recess to accommodate the body 1202 of the product display assembly 1200. The shapes and dimensions of the walls of the cap 1220 are not particularly limited, although they are generally selected to cover the entire back end of the body 1202 and to extend above the panel mounting hooks 1212, 1214 of the product display rail 1206. When mounted to a display panel, a back edge 1532 of the cap 1220 is flush with the display panel and prevents the entire product display assembly 1200 from being removed from the display panel unless the cap 1220 is removed first.

As better shown in FIG. 17, the walls of the cap 1220 define an interior in which the clip 1222 and other components of the product display assembly (the back end of the body 1202 and a back end of the product display rail 1206) are contained. As shown in FIGS. 16A and 16B, the clip 1200 may include an arm 1636 mounted to a base 1634. The base 1634 and arm 1636 extend parallel to one another, although the arm 1636 may be longer than the base 1634. The arm 1636 may be mounted to the base 1634 to define a slot 1638 in between. The arm 1636 may be mounted to the body 1202 by inserting into holes 1356 (see FIG. 13) defined in the right and left shells 1310, 1308 of the body 1202. The arm 1636 may have a flared forked end 1640 to prevent the arm 1636 from being pulled out of the holes 1356. When the clip 1222 is mounted to the body 1202, a back wall of the body 1202 fits within the slot 1638 such that the base 1634 is positioned on the outside of the body 1202 and the arm 1636 is positioned in the inside of the body 1202.

The product display assembly 1200 may also include an electronic circuit device and may be included in a merchandise system as described above with respect to the product display assembly 100.

The product display assemblies and the merchandise systems may be used in a variety of settings, e.g., retail stores, stockrooms, manufacturing facilities, etc.

Unless otherwise specified, the dimensions and shapes of the components of the product display assemblies are not particularly limited. The dimensions and shapes may be selected, in part, depending upon the number and configuration of the products to be displayed as well as the display panel to which the product display assemblies are to be mounted. Similarly, the materials used for the components are not particularly limited, but rather may be selected according to the intended function of the components. By way of illustration, the body, the product display rail, and the other components of the body may be formed from rigid polymers or metal or combinations thereof. The product display belt (including the strip, flaps and hinges) may be formed from flexible polymers. An illustrative flexible polymer is low density polyethylene (LDPE).

Unless otherwise specified, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or thermoforming process. As a result, elements described herein as being mounted to each other need not be discrete structural elements. The elements may be mounted permanently, removably, or releasably unless specified otherwise.

Use of directional terms, such as top, bottom, right, left, front, back, etc. are merely intended to facilitate reference to various surfaces that form components of the devices referenced herein and are not intended to be limiting in any manner.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A product display belt for a product display assembly, the belt comprising:

a flexible strip having a top surface, a bottom surface, a front end and a back end;

a plurality of hinges mounted to the bottom surface of the flexible strip to form linear array of separated hinges extending from the front end towards the back end of the flexible strip; and a plurality of flaps, each flap having a front facing surface, a back facing surface, and a top surface, each flap mounted to an associated hinge of the plurality of hinges at the back facing surface below the top surface of the flap such that the flap has a free top end and extends downwardly away from the bottom surface of the flexible strip, wherein each flap of the plurality of flaps is maintained at a negative angle.

2. The belt of claim 1, wherein the plurality of flaps mounted to the plurality of separated hinges is configured to separate adjacent hanging products in a plurality of hanging products.

3. The belt of claim 1, wherein each flap of the plurality of flaps is shaped having an opening or recess configured to receive a solid product display rail positioned below the flexible strip.

4. The belt of claim 1, wherein each hinge of the plurality of hinges is configured to allow an associated flap to be pushed in a backwards direction towards the back end of the flexible strip over a first angular distance while allowing the associated flap to be pushed in a forwards direction towards the front end of the flexible strip over a second angular distance, wherein the first angular distance is greater than the second angular distance.

5. A product display assembly comprising:

a body;

the product display belt of claim 1, mounted to the body; and a product display rail mounted to the body, the product display rail configured to receive a plurality of hanging products.

6. The belt of claim 5, wherein the product display belt is positioned above the product display rail.

7. The belt of claim 1, wherein the flexible strip comprises a one-piece plastic belt.

8. The belt of claim 1, wherein the hinge is a living hinge.

9. The belt of claim 1, wherein the plurality of flaps manage product being pulled forward on the product display assembly.

10. A product display assembly comprising:

a body having a top surface, a bottom surface, a back surface extending from the top surface to the bottom surface, and a front end opposite the back surface;

a product display belt mounted to the body, the product display belt comprising:

a flexible strip having a top surface, a bottom surface, a front end and a back end, a plurality of hinges mounted to the bottom surface of the flexible strip to form a linear array of separated hinges extending from the front end towards the back end of the flexible strip, and a plurality of flaps, each flap mounted to an associated hinge of the plurality of hinges such that the flap extends downwardly away from the bottom surface of the flexible strip and the bottom surface of the body; and a product display rail comprising an elongated hanging portion, the product display rail mounted to the body such that the elongated hanging portion extends from the back surface of the body towards the front end of the body and approximately parallel to the bottom surface of the body, wherein each flap of the plurality of flaps has an opening or recess configured to receive the product display rail positioned below the flexible strip.

11. The product display assembly of claim 10, wherein the product display belt is positioned above the product display rail.

12. The product display assembly of claim 10, wherein the flexible strip comprises a one-piece plastic belt.

13. The product display assembly of claim 10, wherein the hinge is a living hinge.

14. The product display assembly of claim 10, wherein each flap of the plurality of flaps is maintained at a negative angle.

15. The product display assembly of claim 10, wherein the plurality of flaps manage product being pulled forward on the product display assembly.

* * * * *